US006601548B2

(12) United States Patent
Al-Hawaj

(10) Patent No.: US 6,601,548 B2
(45) Date of Patent: Aug. 5, 2003

(54) AXIAL PISTON ROTARY POWER DEVICE

(76) Inventor: Osama M. Al-Hawaj, P.O. Box 15462, Daiyah (KW)

( * ) Notice: Subject to any disclaimer, the term of this patent is extended or adjusted under 35 U.S.C. 154(b) by 0 days.

(21) Appl. No.: 10/017,980

(22) Filed: Dec. 13, 2001

(65) Prior Publication Data

US 2003/0070634 A1 Apr. 17, 2003

Related U.S. Application Data

(63) Continuation-in-part of application No. 09/977,633, filed on Oct. 15, 2001.

(51) Int. Cl.[7] ..... F02B 57/00
(52) U.S. Cl. ..... 123/56.1; 123/43 AA
(58) Field of Search ..... 123/43 AA, 56.1

(56) References Cited

U.S. PATENT DOCUMENTS 1,209,995 A * 12/1916 Ord ..... 123/43 AA
1,774,713 A * 9/1930 Jahn et al. ..... 123/56.1
1,945,727 A * 2/1934 Braunwalder ..... 123/56.1
2,949,100 A * 8/1960 Petersen ..... 123/43 AA
3,068,709 A * 12/1962 Petersen ..... 123/43 AA
3,945,359 A * 3/1976 Asaga ..... 123/56.1
5,103,778 A * 4/1992 Usich, Jr. ..... 123/43 AA
5,209,190 A * 5/1993 Paul ..... 123/43 AA
6,145,429 A * 11/2000 Paul ..... 123/43 AA
6,155,214 A * 12/2000 Manthey ..... 123/43 AA

* cited by examiner

*Primary Examiner*—Henry C. Yuen
*Assistant Examiner*—Jason Benton
(74) *Attorney, Agent, or Firm*—David Kiewit

(57) ABSTRACT

An axial piston rotary power device can be configured as a four-cycle and two-cycle internal combustion engine, a compressor, a pump, a fluid-driven motor or an expander. The device includes an external stator housing, an internal axial stator and a rotary cylindrical block attached to an end shaft that can rotate within the annular enclosure formed by the two stators. The cylindrical block contains a plurality of cylindrical cavities arranged as pairs of working cylinders. Each cylindrical cavity encloses a double-acting piston assembly comprising two piston heads connected to a middle portion having a pair of axially spaced apart roller cam followers that make roller contact with a guide cam surface protruding from the inside of the external stator housing. The action of the cam roller followers on the guide cam imparts rotation to the cylindrical block when the piston assemblies reciprocate within their respective bores.

30 Claims, 26 Drawing Sheets

I : Intake
C : Compression
P : Power
E : Exhaust

I : Intake
E : Exhaust
P : Power
C : Compression
INJ : Injection

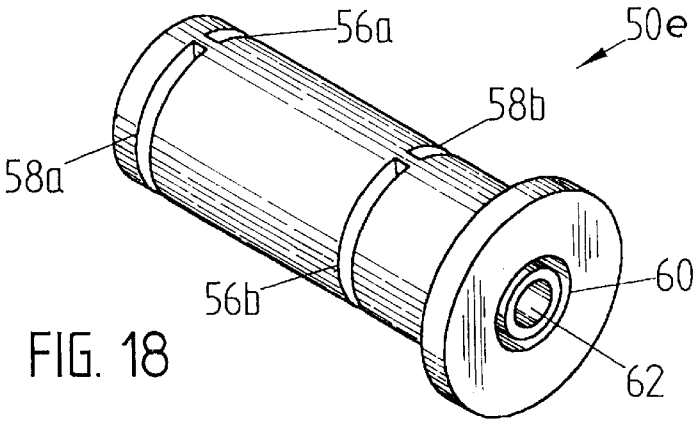
FIG. 18
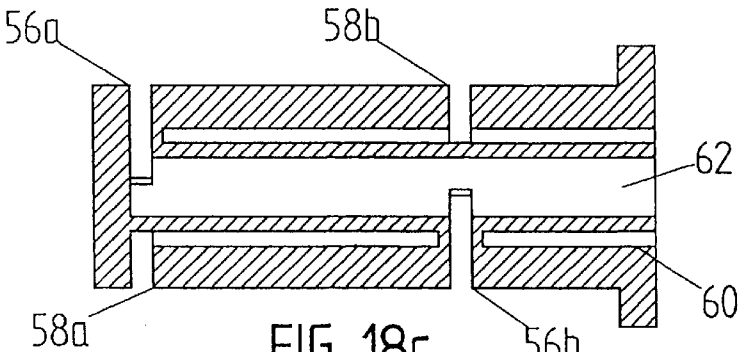
FIG. 18c
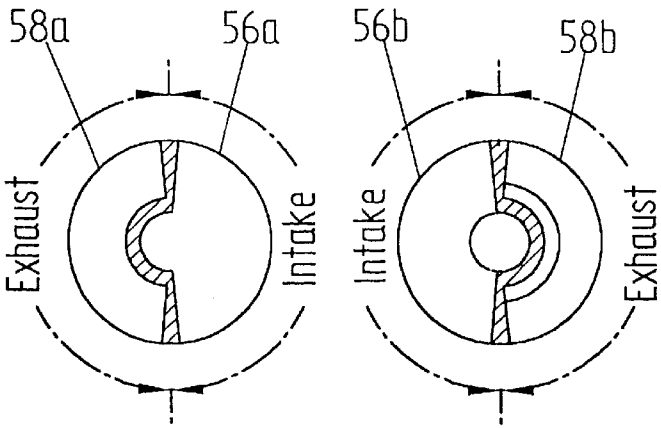
FIG. 18a
FIG. 18b
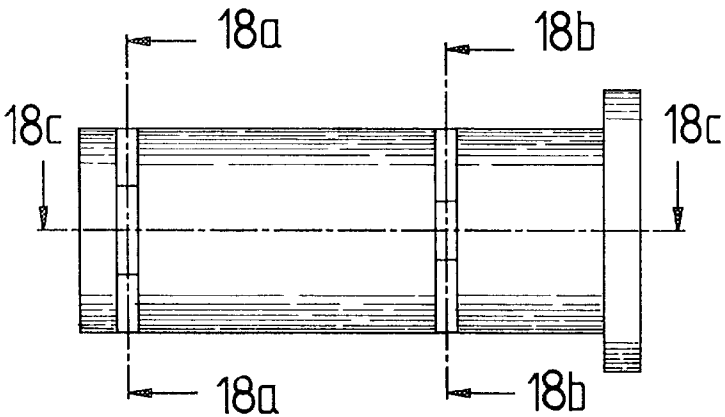
FIG. 18s

AXIAL PISTON ROTARY POWER DEVICE

CROSS REFERENCE TO RELATED APPLICATIONS

This application is a continuation-in-part of the inventor's U.S. Ser. No. 09/977,633 filed on Oct. 15, 2001.

BACKGROUND OF THE INVENTION

1. Field of the Invention

The invention relates to axial piston rotary power devices having one or more pistons disposed parallel to and displaced from an axis of rotation. More particularly, the invention relates to internal combustion engines, pumps, compressors, expanders, fluid driven motors, compressor driven internal combustion engines, and fluid driven compressors. It additionally relates to any such devices that differ in a simple structural modification of a central cylindrical stationary member, cam profile and end plate ports.

2. Background Information

This invention relates to rotary power devices of the type having a plurality of cylinders arranged around and parallel to a central axis of rotation in an equally-spaced relationship, and in which pistons disposed within the cylinders cooperate with a cam track to impart rotational motion to a rotor when the pistons reciprocate in their respective cylinders. Examples of rotary devices of the above type can be found in United States patent specifications such as U.S. Pat. No. 5,813,372 of Manthey; U.S. Pat. No. 4,287,858 of Anzalone; U.S. Pat. No. Re. 30,565 and U.S. Pat. No. 4,157,079 of Kristiansen; U.S. Pat. No. 5,209,190 of Paul; U.S. Pat. No. 5,103,778 of Usich, Jr.; U.S. Pat. No. 5,253,983 of Suzuki, et al.; U.S. Pat. No. 5,323,738 of Morse; U.S. Pat. No. 4,213,427 of Di Stefano; and U.S. Pat. No. 1,614,476 of Hutchinson. Although such power devices have been proven to be theoretically functional, they are characterized in some respects by complexities associated with the arrangements of cams and of intake and discharge means, which make them costly to manufacture, assemble, and maintain. Furthermore, the apparatus of the present invention represents one or more improvements over a device described in the inventor's pending U.S. patent application Ser. No. 09/977,633, filed on Oct. 15, 2001, the disclosure of which is herein incorporated by reference.

BRIEF SUMMARY OF THE INVENTION

An axial piston rotary power device of the invention comprises a stator portion and a rotor portion having a rotatable shaft extending along an axis of the device. The stator portion of the device comprises an external stator portion defining a generally cylindrical interior bounded by a back plate portion and a front plate portion that has a central throughhole within which the rotatable shaft is journaled. A middle portion of the external stator is preferably formed from a pair of diagonally-split mating elements. In addition, the stator comprises a cylindrical internal stator portion projecting from the back plate portion into the cylindrical interior along the axis of the device so as to define an annular space extending between the internal and external stator portions. The internal stator portion has a plurality of passageways within it, each of the passageways comprising a channel parallel to the axis and each of the channels communicating with at least one respective radially oriented port formed in the internal stator at a respective selected axial position. Yet another static portion of a preferred device is an axially undulating guide track surface that may comprise a surface protruding inwardly, by a predetermined amount, from the annular internal wall of the middle portion of the external stator of the device.

The rotor portion of the device comprises a cylindrical block having a medial annular cutout portion extending through its outer surface so as to form an annular recess. The block is fixedly attached to the shaft and rotatable within the annular space between the internal stator portion and the external stator portion and is arranged so that a protruding guide track surface attached to or forming a portion of the middle portion of the external stator fits into the annular cutout. This block has a central cylindrical bore adapted to receive the internal stator, and also includes a selected number of cylindrical cavities parallel to the axis of the device and spaced apart from that axis by a single selected radial distance. Each of the cylindrical cavities is divided into a pair of working cylinders axially separated from each other by a portion of the annular cutout. Each of these cylindrical cavities has a radially inwardly directed end opening adjacent each of its two ends. One of these end openings is associated with a working cylinder in the first set thereof and may communicate with the central cylindrical bore at a first selected axial position. The other end opening in each cylindrical cavity is associated with the associated working cylinder of the second set and may communicate with the central cylindrical bore at a second selected axial position. Alternatively, working cylinders of the first set may comprise respective end openings communicating with the central bore at one selected axial position, and working cylinders of the second set may comprise axial end openings communicating with passages formed in one of the end plates of the external stator.

It will be recognized that either working cylinder arrangement can be described in terms of two sets of working cylinders aligned parallel to the axis of the device, wherein each of the sets comprises a circular array and wherein each cylinder in one set is axially aligned with a respective one of the working cylinders in the other set.

In addition, the annular surface of the cutout portion of the cylindrical block may include an equal number of axial cam grooves extending between ones of each pair of working cylinders. In an operating configuration, each pair of axially opposed working cylinders slidably receives a respective piston assembly. Each of the piston assemblies comprises two opposed cylindrical piston heads fixedly coupled by a middle portion which preferably comprises a pair of axially spaced apart roller cam followers receiving the protruding cam guide. In addition, the middle portion of the piston assembly preferably includes a detachable cam pin follower slidably engaging the cam groove. All of the roller cam followers engage the undulating protruding guide surface so as to couple a rotary motion of the block to the reciprocating translational motions of the pistons. If the pistons are driven to and fro within the cylinders by known means such as the expansion of an explosive air-fuel charge, or by the introduction of a pressurized working fluid, the rotary power device of the invention can function as an internal combustion engine, a fluid-driven compressor, a compound internal combustion and compressor, a fluid-driven motor or expander device providing output shaft power. Conversely, if the block is rotated by the application of a torque to the input shaft, the rotary power device of the invention can function as a pump or compressor.

One embodiment of the present invention provides an improved spark ignition rotary internal combustion engine which operates in a four-cycle mode and which overcomes problems presently encountered in the class of rotary engine having pistons positioned parallel to each other around a common axis of rotation. Another embodiment of the present invention provides an improved rotary internal combustion engine which operates in a two-cycle mode and which overcomes problems presently encountered in the class of rotary engines having pistons positioned parallel to each other around a common axis of rotation.

Another feature of a preferred rotary power device of the invention is that it can be easily converted to a different type of rotary power device by a simple modification or replacement of a central stationary member, cam profile or front end plate. Thus, one can convert an internal combustion engine of the invention into a rotary power device that can act as any one of a pump, a compressor, a fluid-driven pump, a fluid-driven compressor, a fluid-driven motor and an internal combustion-driven compressor A preferred embodiment of the invention provides a rotary power device having valveless ports.

A feature of some embodiments the invention is that they are light in weight, small in size and have a reduced part count when compared with prior art rotary power devices.

A benefit of some embodiments of the invention is that they provide a rotary power device that closely approximates continuous intake, compression, combustion and discharge processes.

Another benefit of some embodiments of the invention is that they provide a rotary power device characterized by reduced noise and vibration.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the herein before recited features and advantages of the invention, and that less than all of the recited features and advantages may be provided by some embodiments.

BRIEF DESCRIPTION OF THE SEVERAL VIEWS OF THE DRAWING

FIG. 18 is an isometric view of an alternative internal stator of the rotary power device of FIG. 11, the device operating as two-cycle pump, compressor, fluid-driven motor or expander device.

FIG. 18*s* is a side elevation view of FIG. 18.

FIG. 18*a* is a sectional view taken along line 18*a*—18*a* of FIG. 18*s*.

FIG. 18*b* is a sectional view taken along line 18*b*—18*b* of FIG. 18*s*.

FIG. 18*c* is a sectional view taken along line 18*c*—18*c* of FIG. 18*s*.

DETAILED DESCRIPTION OF THE INVENTION

FIGS. 1–9, illustrate the principles of this invention in embodiments configured as a four-cycle internal combustion engine. FIGS. 11–17 illustrate the principles of this invention in embodiments configured as a two-cycle internal combustion engine. A complete reading of the disclosure will lead one skilled in the art will to understand that these same principles can be successfully employed to yield other devices, such as four-cycle and two-cycle pumps, compressors, fluid-driven motors, fluid-driven compressors, expander devices, and internal combustion-driven compressors. These devices are as shown in FIGS. 3*a*, 4*a*, 10, 10*a*–*f*, 11*a*, 12, 12*a*, 18, 19, 20*a* and 20*b*, respectively, comprise a simple modification or replacement of the central stationary member and/or end front plate.

Figure 3:
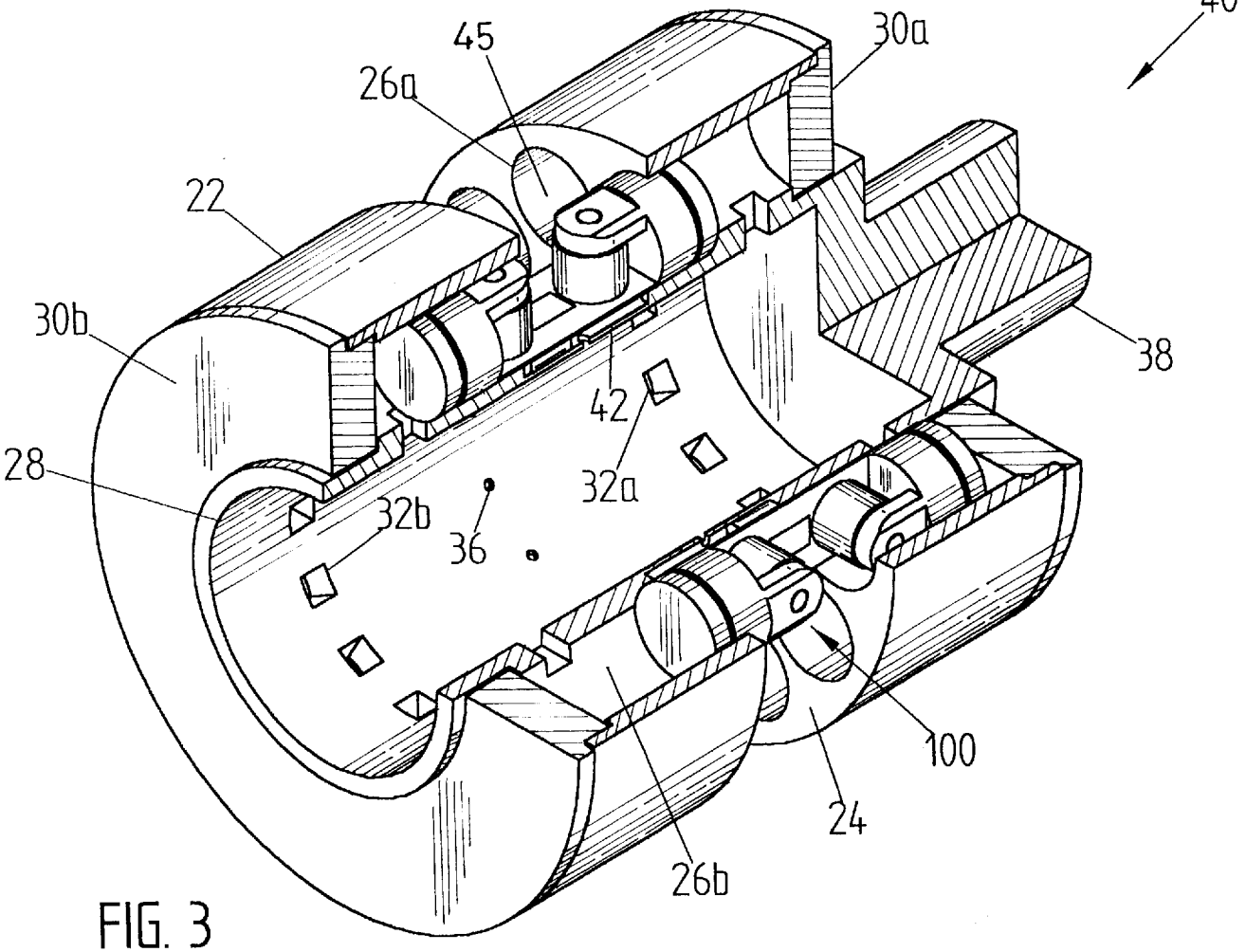
FIG. 3 is an isometric view of the rotor-piston assembly of the rotary power device of FIG. 1, the view having portions cut away for purposes of illustration.
Figure 4:
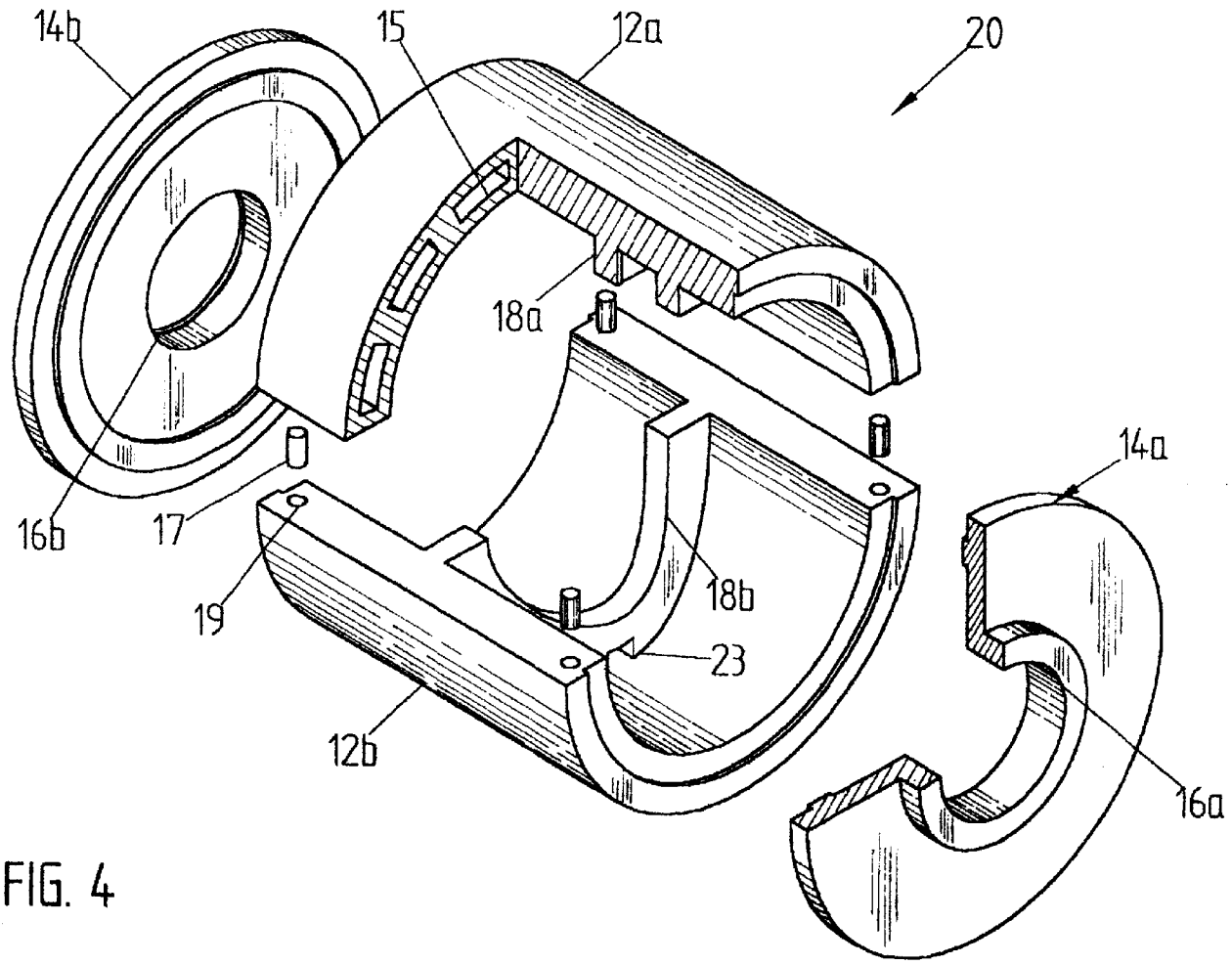
FIG. 4 is an exploded isometric view of the cam and external stator of the four-cycle rotary power device of FIG. 1 having the upper cam portion cut away for purposes of illustration.
Figure 4A:
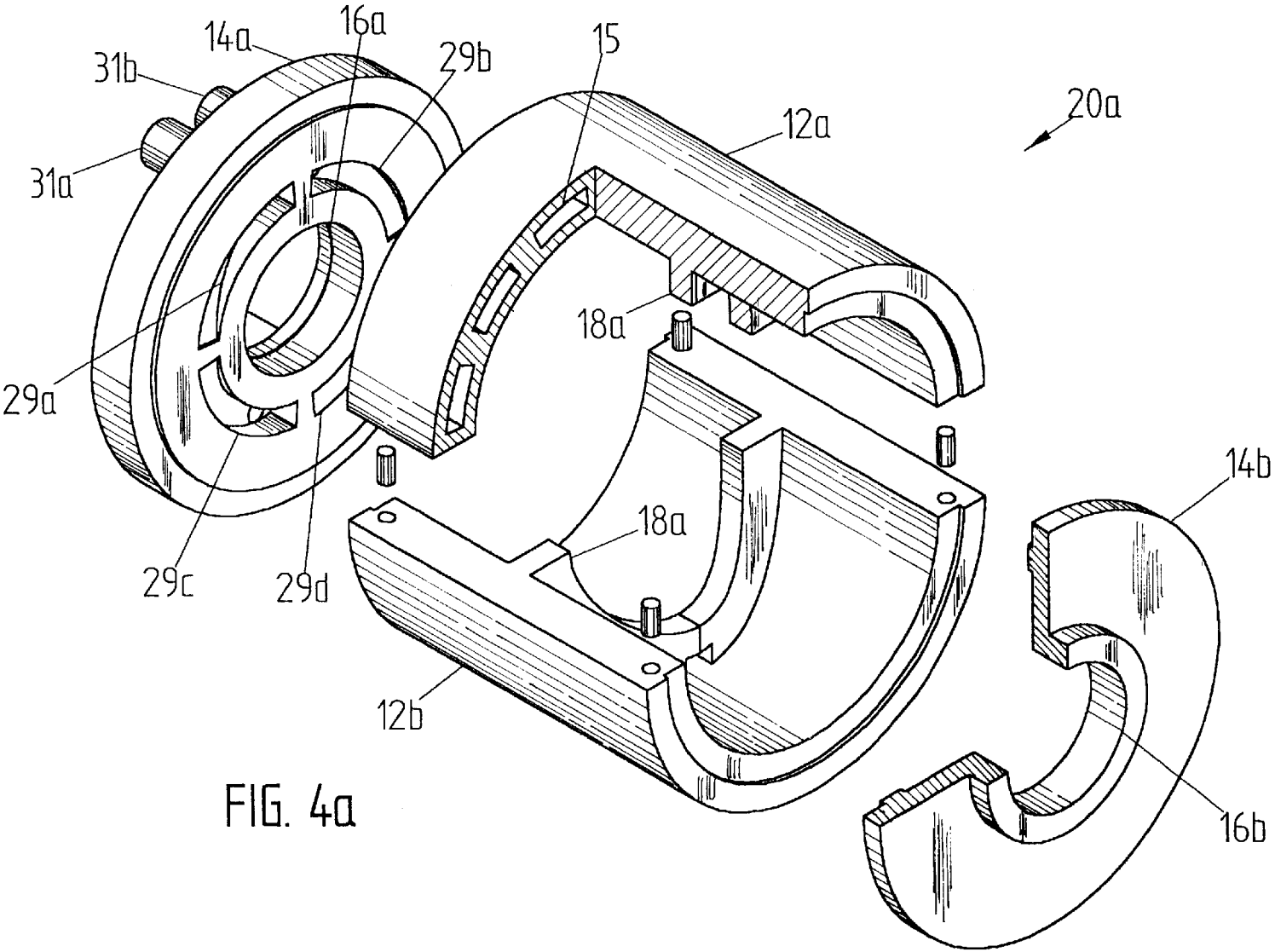
FIG. 4*a* is an exploded isometric view of the cam and external stator of the four-cycle rotary power device employing the alternative rotor-piston assembly of FIG. 3*a* and having the upper cam portion cut away for purposes of illustration.

Referring to FIGS. 1–9, a depicted embodiment of the rotary power device 10 of the invention comprises a stationary housing 20 having a generally cylindrical interior. The housing, or external stator 20, preferably comprises a middle portion comprising diagonally split cylindrical halves, comprising an upper half 12*a* and lower half 12*b*, forming a generally cylindrical interior that is closed off at its ends by a front end plate 14*a*, having a central throughhole opening 16*a*, and a back end plate 14*b*, having a central throughhole 16*b*. The diagonally split block can be joined along a line that is a diagonal of the cylindrical block In some embodiments an end plate 14*a*, as shown in FIG. 4*a*, may comprise four circular arcuate passages 29*a*, 29*b*, 29*c* and 29*d* formed into the inner surface of the plate (e.g., by a cutting operation) and connected to respective ports 31*a*, 31*b*, 31*c*, and 31*d*. These passages may comprise two diagonally opposed fluid intake passages alternated by two diagonally opposed discharge passages. Furthermore, the middle portions of the halves may be aligned by means of alignment pins 17 and corresponding holes 19, and preferably include a multiplicity of cooling passages 15 through which a coolant medium may be circulated by using appropriate intake and discharge ports (not shown). In addition, the lower middle portion 12*b* preferably includes a passage 23 connected to a port 21 for supplying or withdrawing lubricant, which may serve as an internal cooling fluid in addition to providing a lubricating function. The end plates 14*a* and 14*b* are preferably secured to the middle portions 12*a* and 12*b* of the stationary housing by tie rods and bolts or other known fastening means (not shown). A generally cylindrical internal stator 50 extends along an axis 13 of the device into the interior of the housing 20 from the end plate central opening 16*b* and is fixedly attached to the back end plate 14*b* by bolts or other suitable fastening means (not shown).

A protruding cam is disposed within the cylindrical housing 20 and preferably comprises a pair of diagonally mating portions comprising an upper portion 18*a* and a lower portion 18*b*. Each cam portion, as shown in FIG. 4, is preferably formed as an inward surface protrusion extending from an inner surface of a middle portion of the housing 20 and having axially undulating guide track surfaces. In a four-cycle device, the cam surface comprises a first pair of points at which the guide track surface is a maximum distance from the back end plate 14*b*, and a second pair of points at which the guide track surface is a minimum distance from the back end plate 14*b*. These minima and maxima are disposed in alternating fashion.

Figure 1:
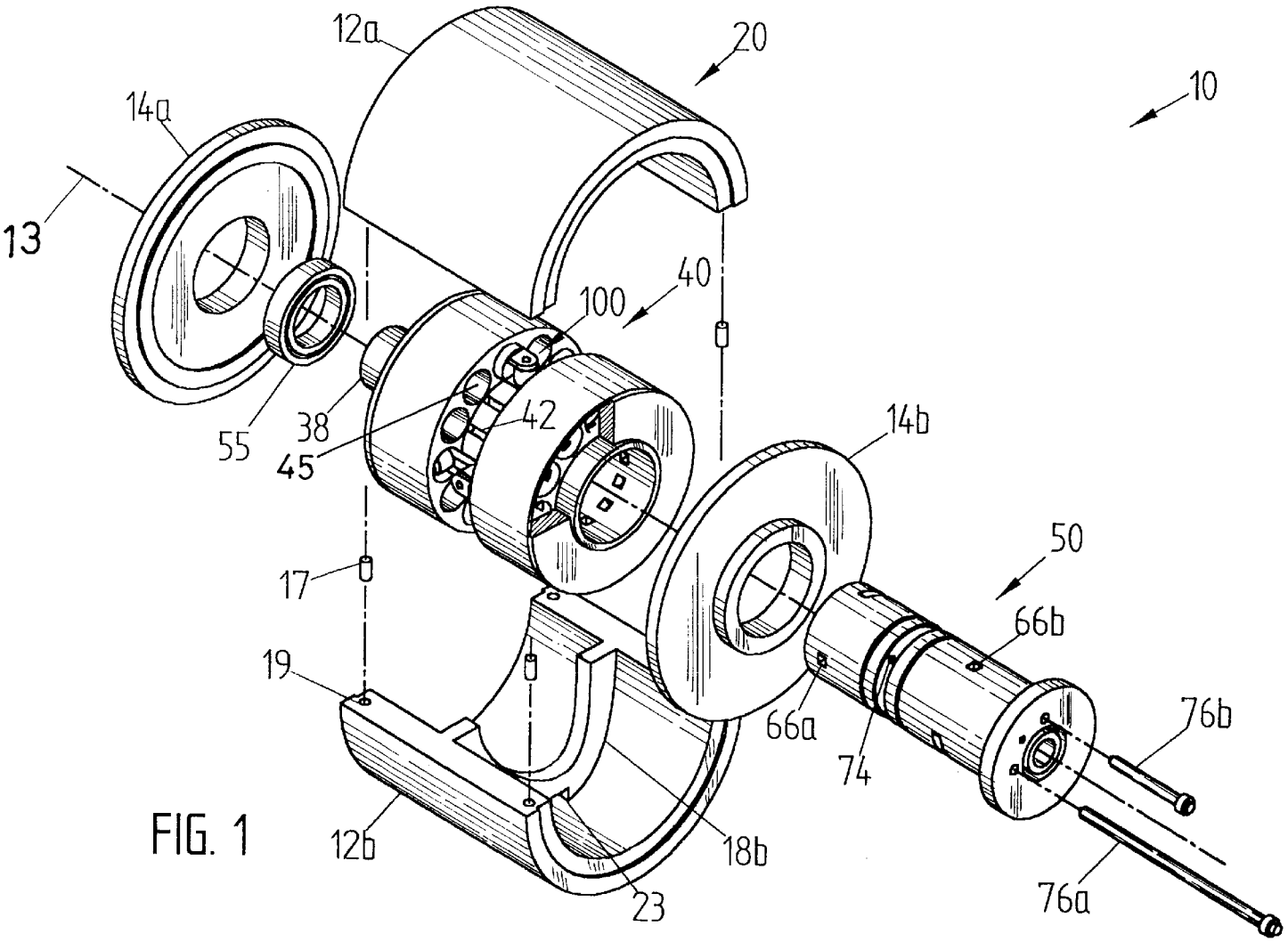
FIG. 1 is an exploded isometric view of a four-cycle rotary power device.
Figure 2:
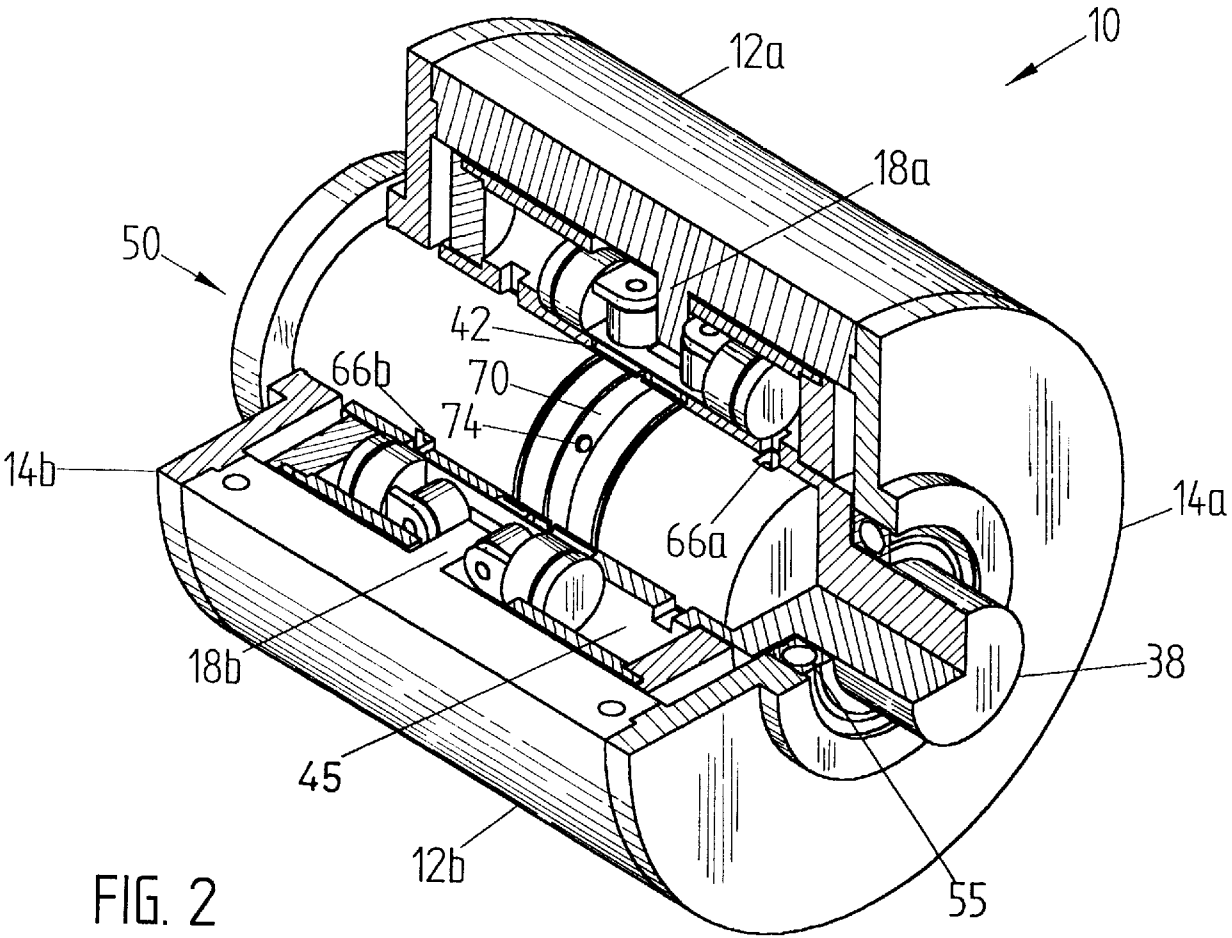
FIG. 2 is an isometric view of a four-cycle rotary power device of FIG. 1 having quarter portions cut away from the rotor and an external stator for purposes of illustration.
Figure 5:
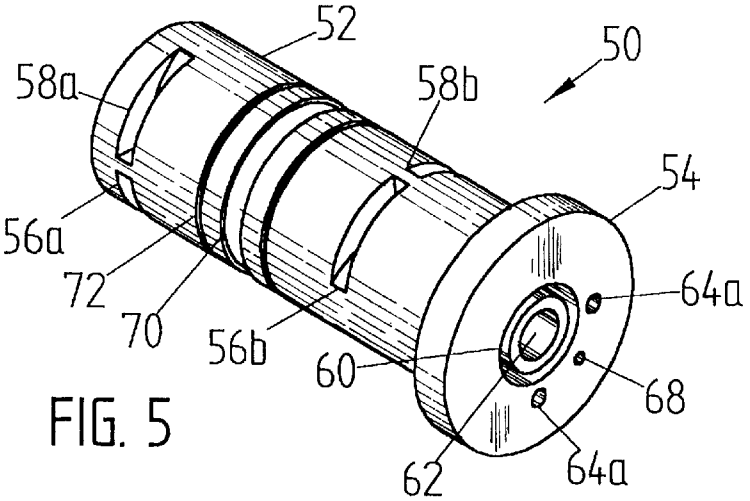
FIG. 5 is an isometric view of the internal stator of the rotary power device of FIG. 1 functioning as a four-cycle internal combustion engine.
Figure 5S:
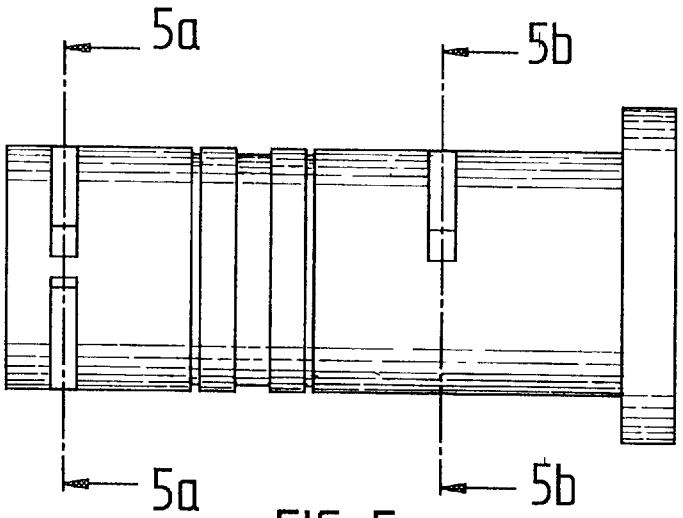
FIG. 5*s* is a side elevation view of the internal stator of FIG. 5.
Figure 5B:
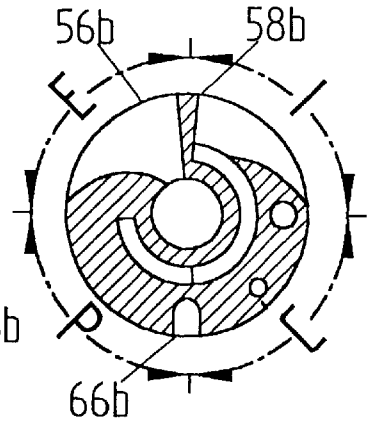
FIG. 5*b* is a sectional view taken along line 5*b*—5*b* of FIG. 5*s*.
Figure 5A:
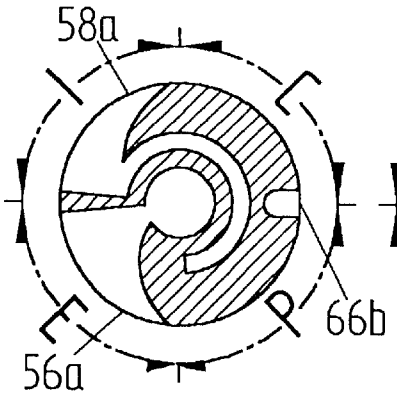
FIG. 5*a* is a sectional view taken along line 5*a*—5*a* of FIG. 5*s*.
Figure 6:
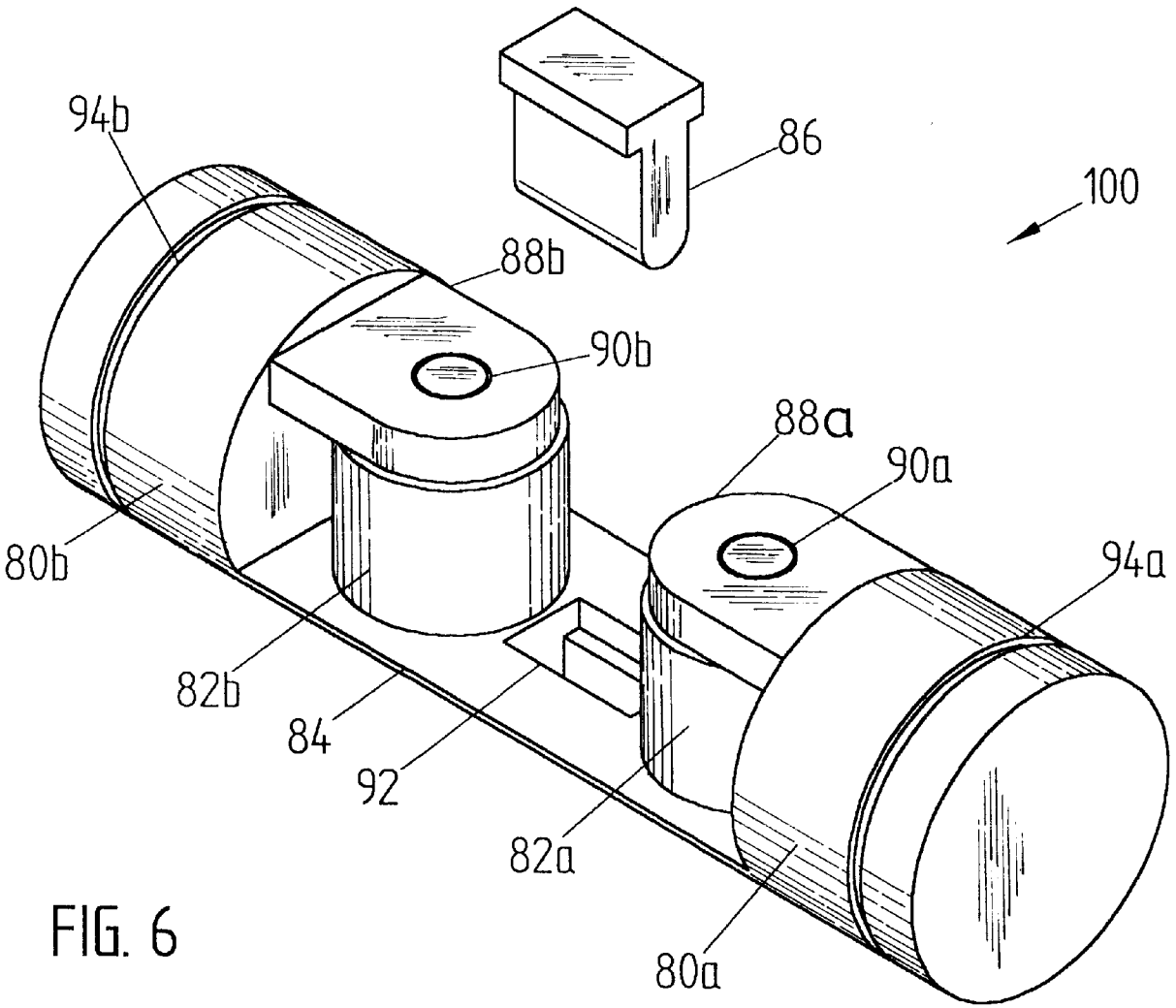
FIG. 6 is an exploded isometric view of the piston assembly of the rotary power device of FIG. 1.
Figure 7:
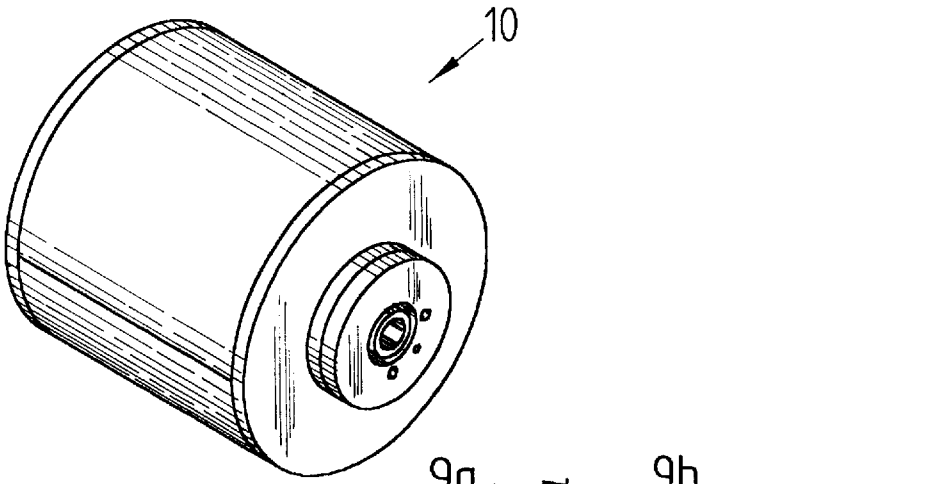
FIG. 7 is an isometric view of rotary power device of FIG. 1.
Figure 7S:
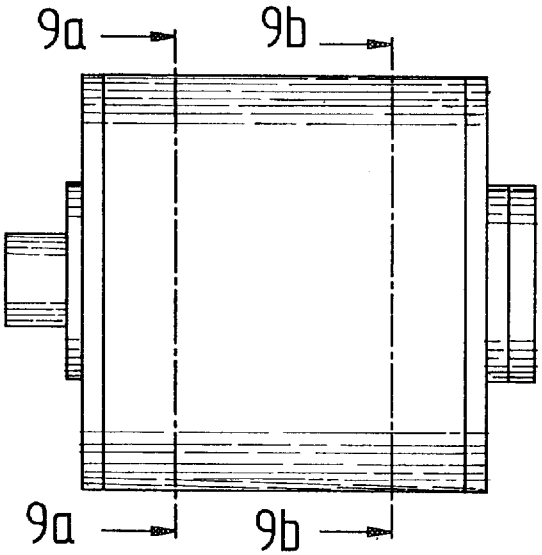
FIG. 7*s* is a side elevation view of the rotary power device of FIG. 7.
Figure 7E:
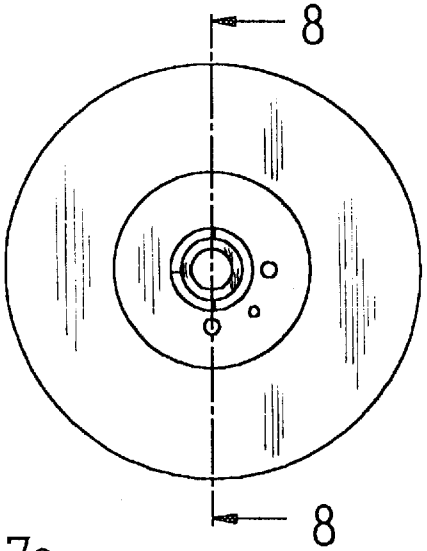
FIG. 7*e* is an end view of the rotary power device of FIG. 7.
Figure 8:
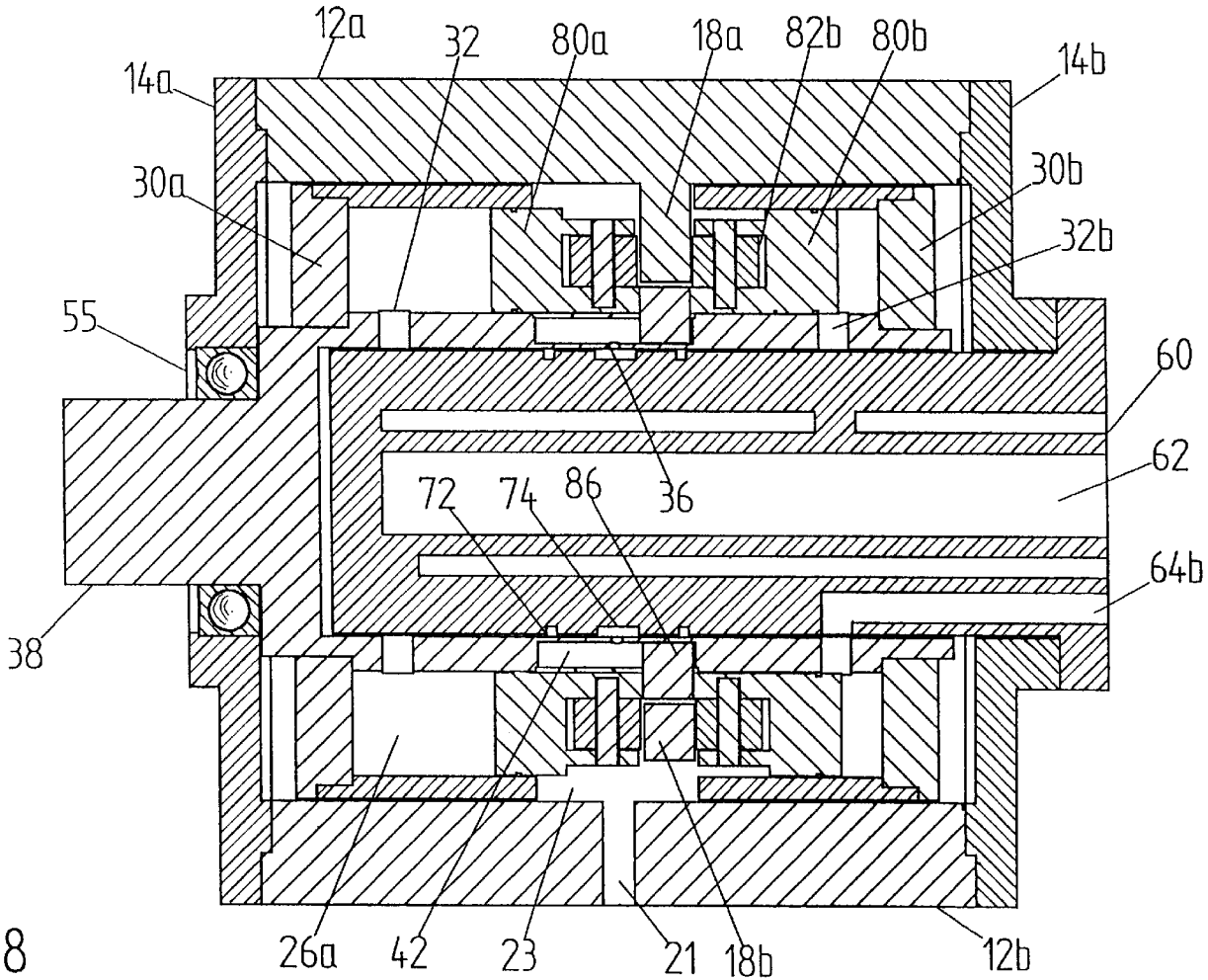
FIG. 8 is a sectional view taken along line 8—8 of FIG. 7*e*.

The central internal stator 50, as shown in FIG. 1 and FIG. 5, preferably comprises a cylindrical portion 52 extending coaxially through the interior, and an end flange portion 54 for fixedly attaching the stator to the end back plate 14*b*. Furthermore, the cylindrical portion 52 is preferably provided with four lateral cutout openings forming one pair of angularly adjacent intake and discharge ports 56*a*, 58*a* that are axially spaced apart from a similar second pair of angularly adjacent intake and discharge ports 56*b*, 58*b*. The two pairs 56*a*, 58*a*; 56*b*, 58*b* of ports are arranged to have a 90° angular phase shift relative to each other. Each port cutout opening is defined within an angular extension of approximately 90° and has an angularly varying radial depth profile. These lateral openings communicate with axial intake circular channels 62 and discharge annular channel 60. In alternative embodiment (not shown) the intake ports communicate with an annular channel 60 and the discharge ports communicate with a circular discharge channel 60. A first ignition port 66*a* is disposed approximately diametrically opposite to a corresponding angularly adjacent pair of intake and discharge ports 56*a*, 58*a*. A second, similar, ignition port 66*b* is disposed diametrically opposite to the intake and discharge ports 56*b*, 58*b*. These ignition ports 66*a* and 66*b* are connected to axial channels 64*a* and 64*b* and may comprise means for receiving igniters 76*a*, 76*b*, which may comprise spark plugs screwed into a threaded portion of the channel. An annular recess 70 for distribution of lubricant may also be provided in the internal stator portion 52 which is adapted to receive lubricant from port 74 communicating with axial channel 68. Furthermore, two recesses 72 may be provided in order to receive sealing rings (not shown) that would enclose the lubricating recess 70.

Figure 3A:
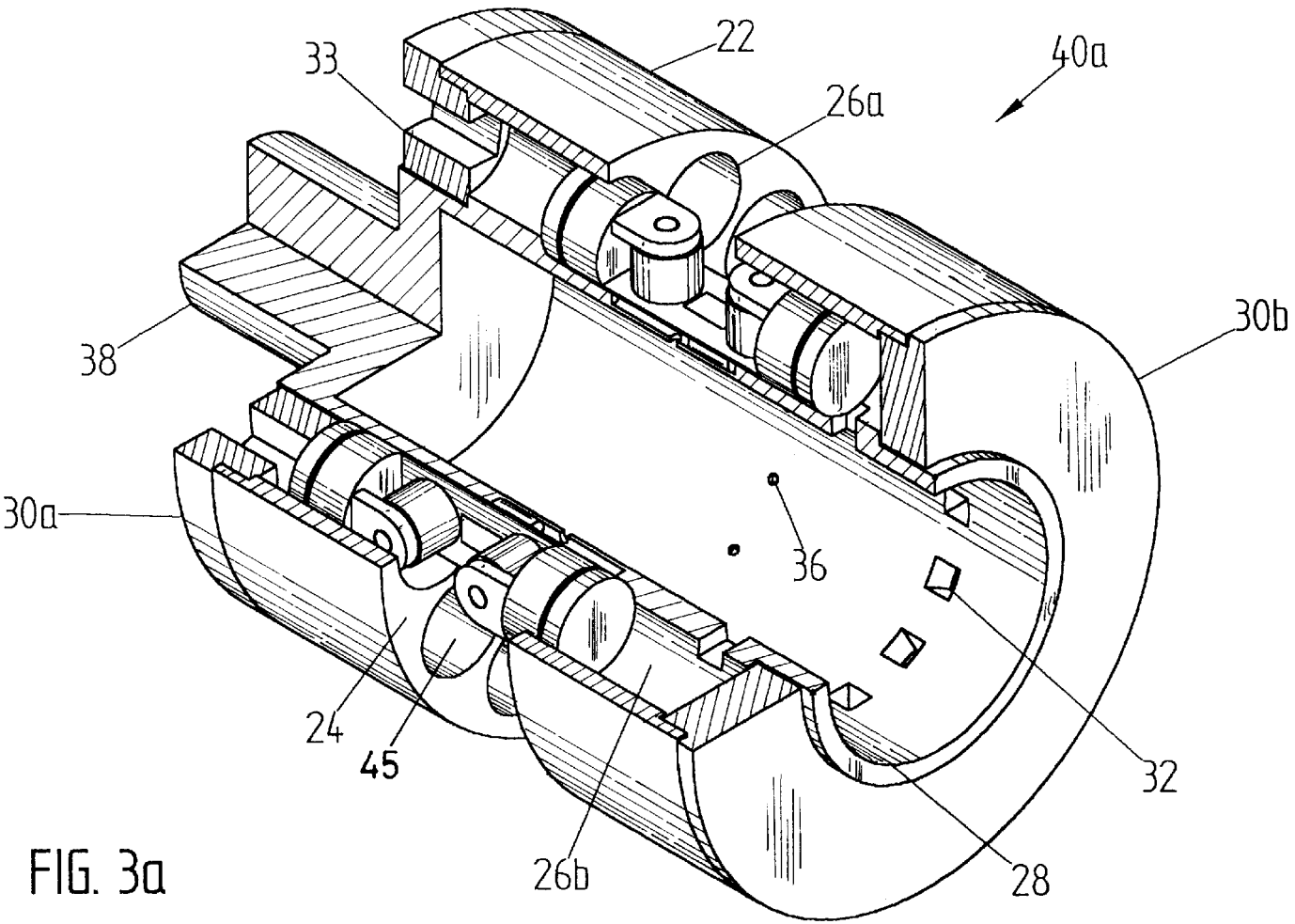
FIG. 3*a* is an isometric view of an alternative rotor-piston assembly of the rotary power device of FIG. 1 having portions cut away for purposes of illustration

The rotor-piston assembly 40 is disposed in the generally annular space formed between the internal stator 50 and the inner wall of the external stator 20. This assembly 40, as shown in FIG. 3, comprises a cylindrical block 22 having a medial annular cutout or recess portion 24 enclosed between a pair of multiplicity of axially oriented working cylindrical bores 26*a* and 26*b*. Each of the working cylinders is parallel to and preferably equidistant from the axis 13 of the device and the working cylinders are preferably spaced at equal angular intervals surrounding the central bore 28. Furthermore, the working cylinders 26*a* and 26*b* have inner end opening through the annular recess 24 and outer end openings closeable by cover ring plates 30*a* and 30*b*, respectively, that may be retained by fixture means (not shown). The lateral surface of the annular recess 24 may include a multiplicity of axial cam grooves 42 extending axially between two axially opposed working cylinders. The rotor assembly 40 preferably includes an axial shaft 38 fixedly attached to one end of the cylindrical block 22 and rotatably journaled within a bearing means 55 supported in the front end plate 14*a*. The shaft 38 extends outwardly through the end plate central opening 16*a* for transmitting output shaft power in versions of the rotary power device that are configured as engines and for receiving an input torque in versions of the rotary power device that are configured as pumps or compressors. In the example depicted in the drawing, there are twelve cylindrical cavities 45 disposed parallel to each other and to the axis of rotation of the shaft 38. Each cylindrical cavity 45 comprises a pair of working cylinder 26*a* and 26*b*, each of which has respective radially inward openings 32*a* and 32*b* disposed adjacent their respective outer ends and communicating with the central bore 28. Alternatively, as shown in FIG. 3*a*, the working cylinders 26*a* adjacent the front plate, instead of having a radially inward end opening, may have an axial end opening through the front ring plate 30*a* that communicates with channels 29*a*, 29*b*, 29*c* and 29*d* in the front end plate.

A reciprocating piston assembly 100, as shown in FIGS. 1, 2, 3 and 6, may be axially disposed within the annular recess having opposed cylinder heads, each slidingly engaging respective pistons in respective workings cylinders 26*a* and 26*b*. Each piston assembly comprises two opposed cylindrical heads 80*a* and 80*b* fixedly coupled by a middle portion 84. The middle portion preferably includes a pair of axially spaced apart roller cam followers 82*a* and 82*b* supported by corresponding brackets 88*a* and 88*b* and by pins 90*a* and 90*b*. These roller cam followers make roller contact with the surfaces of the protruding cam track portions 18*a* and 18*b*. The middle portion 84 further includes a slot opening 92 adapted to receive a cam follower pin 86 for slidably engaging the axial cam groove 42 in the rotor annular recess. Ring recesses 94*a* and 94*b* may be provided to receive ring seals (not shown) in each piston head.

Figure 9B:
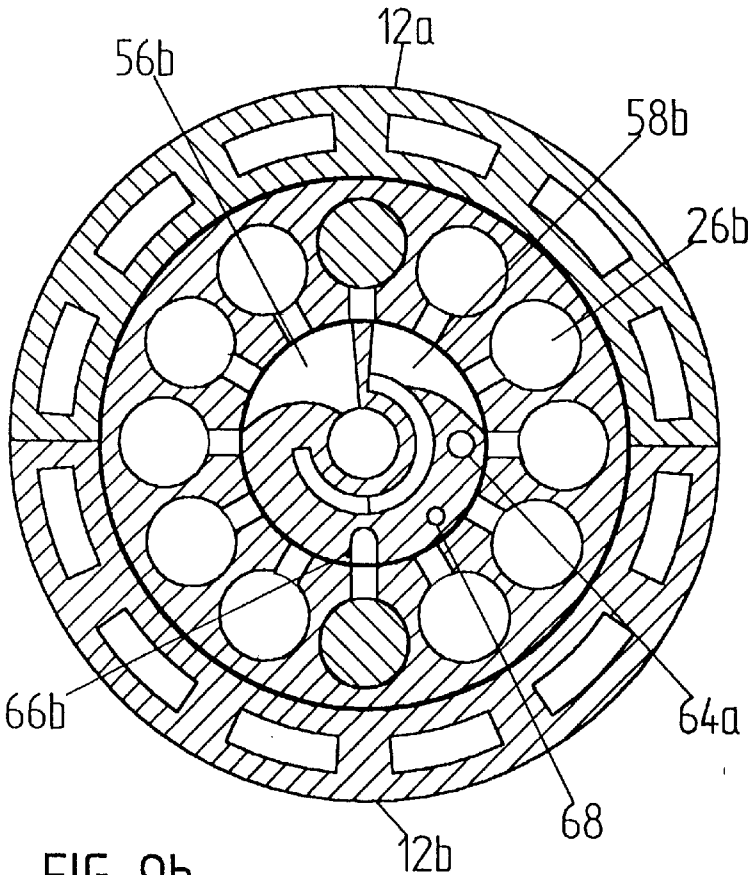
FIG. 9*b* is a sectional view taken along line 9*b*—9*b* of FIG. 7*s*.
Figure 9A:
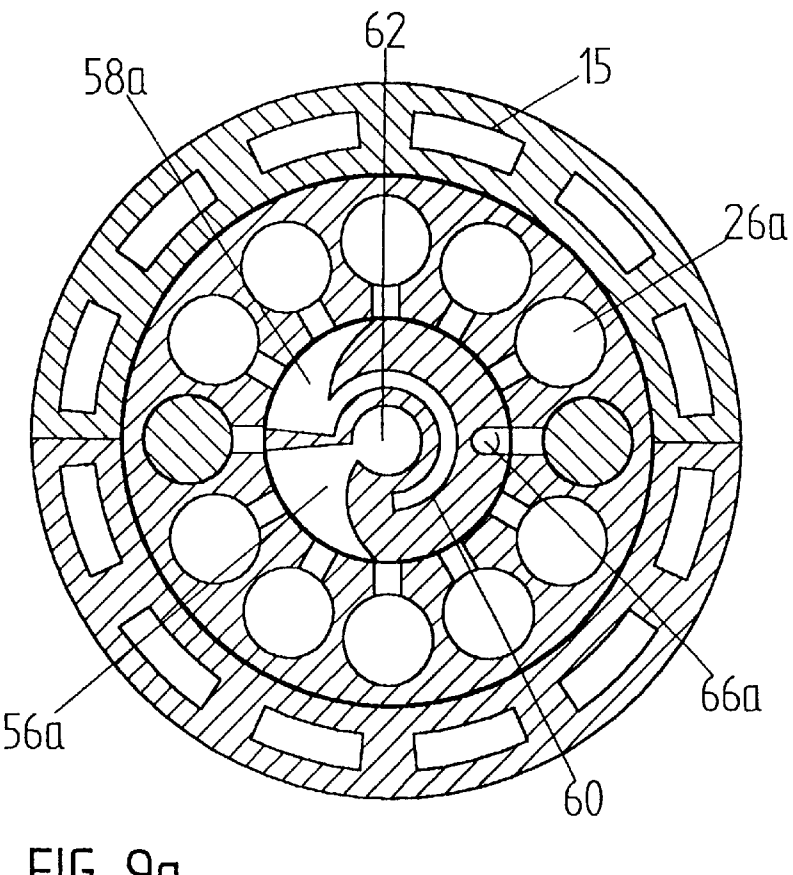
FIG. 9*a* is a sectional view taken along line 9*a*—9*a* of FIG. 7*s*.

An understanding of the operation of the rotary power device 10 of the invention as a four-cycle internal combustion engine may be gained by reference to the depiction of FIGS. 5*a*, 5*b*, 8, 9*a*, and 9*b*. This engine may be started by means of a starter motor (not shown) temporarily connected to the shaft 38 to initiate the rotation of the rotor assembly 40. Fluid pressure forces are transmitted from the heads of piston assemblies 100 to respective roller can followers 82*a* and 82*b* that are in rolling contact with the protruding cam track surfaces 18*a* and 18*b* to result in a normal reaction force. The tangential components of the normal reaction forces of these contact forces are transmitted to the axial cam groove 42 by means of cam follower pin 86 thereby developing a torque causing the rotation of the rotor assembly. At the same time, the piston assemblies 100 reciprocate in their respective working cylinders 26*a* and 26*b*. A step-by-step analysis of the process may begin with by recourse to a limiting position in which one working cylinder, say 26*a*, of a pair thereof is at its minimum operating volume. This exemplar starting position corresponds to the so-called top dead center (TDC) in a conventional engine. In this arrangement the working cylinder 26*a* is bounded by one piston head 80*a* and end cover plate 30*a*. As the piston element starts moving away from the end wall 30*a* it uncovers an end opening 32*a* in the respective cylinder, and an air/fuel mixture charge is drawn into the cylinder from the intake port 56*a* of the internal stator 50 as the rotor assembly 40 completes the first 90° of angular displacement. At this point the volume reaches a maximum, corresponding to the first bottom dead center (BDC) position in a conventional engine. During the second 90° of angular displacement of the rotor assembly, the piston head 80*a* starts moving back toward the end wall 30*a* while the end opening 32*a* is blocked by the wall portion 52 of the internal stator 50, thereby compressing the air/fuel mixture to a minimum volume, corresponding to the second (TDC) position. At the beginning of the third 90° of angular displacement of the rotor assembly, the end opening 32*a* aligns itself with ignition port 66*a* so that a spark from a spark plug 76*a* can initiate combustion and power expansion. After the expansion the volume reaches its second maximum corresponding to the second (BDC) position in a conventional engine. During the fourth 90° of angular displacement of the rotor assembly, the opening 32*a* registers with the discharge port 58*a* as the piston head 80*a* moves toward the end wall 30*a*, thereby discharging combustion products as the piston moves towards its second TDC. The other end of the piston assembly 100 performs an identical cycle but with a 90° phase shift. For example, as one of the working cylinders in a cylindrical cavity 45 performs an intake stroke the paired working cylinder performs a compression stroke. As illustrated in FIGS. 9*a*–9*b*, the present rotary engine comprises two sets of working cylinders aligned parallel to the axis of the device, wherein each of the sets comprises a circular array and wherein each working cylinder in one set is axially aligned with a respective one of the working cylinders in the other set, each set comprising twelve working cylinders performing, in one revolution of the rotor assembly, the equivalent of twenty-four cylinders in two revolutions of the conventional four-cycle spark ignition engine.

A rotary power device of the invention may be cooled by means of primary and secondary cooling systems. The primary cooling system may comprise a lubricating fluid, such as oil, that is forced through an axial channel 68 in the internal stator, conveyed by radial port 74 to the lubricating annular recess 70, and finally by means of lubricating holes 36 in groove cam 42 to the piston assemblies and rotor external surfaces. The lubricating fluid in the groove cam 42 is forced by the effect of centrifugal forces and friction forces to the protruding cam surfaces, working cylinder internal surfaces and into the clearance gap between the rotor exterior surfaces and inner surfaces of the external stator 20. The lubricating fluid may be removed by means of a port 21 in the lower middle portion 12*b* of the external casing and then cooled by an external secondary cooling loop (not shown) before returning back to the channel 68. Also, a secondary cooling fluid such as water, may be used by circulating it through jacket cooling passages 15 in the external casing 20. The use of primary and secondary cooling system permits the heat transfer from the primary lubricating cooling fluid to the secondary non-lubricating cooling fluid.

The rotary power device can be easily converted to serve a different purpose other than the internal combustion engine by replacing the internal stator 50 with a modified internal stator Referring to FIG. 10, 10*s*, 10*a* and 10*b*, a rotary power device employing a modified central stator 50*a* can function as any one of a motor-driven compressor or pump, a fluid-driven motor, and an expander device operating in four-cycle mode. In this configuration, the internal stator comprises two sets of intake and discharge ports, where each set is defined in one plane transverse to the axis 13 and is axially spaced apart from a second plane that includes the second set. Moreover, each set is in alignment with respective working cylinders end opening 32*a* and 32*b* of the rotor assembly. Each set thus comprises two diagonally opposed intake ports alternated by another two diagonally opposed discharge ports. Each set forms a 90° angular displacement relationship with respect to the other set. Each intake and discharge ports is defined within approximately a 90° angular displacement. The four intake ports 56*a*, 56*b*, 56*c*, and 56*d* communicate with a common central axial intake conduit 62, while the four discharge ports 58*a*, 58*b*, 58*c*, 58*d* communicate with the annular channel 60. Alternately, (not shown) the four intake ports may communicate with the annular channel 60 while the four discharge ports communicate with the central channel 62.

Figure 10:
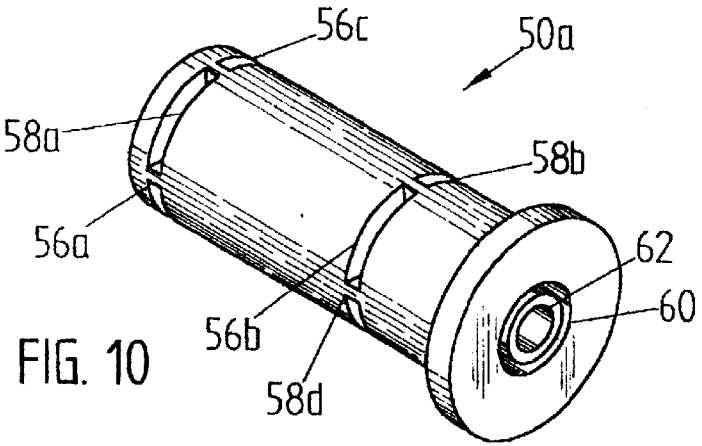
FIG. 10 is an isometric view of an alternative internal stator of the rotary power device of FIG. 1, the device operating as a four-cycle pump, four-cycle compressor, four-cycle fluid-driven motor or four-cycle expander device.
Figure 10S:
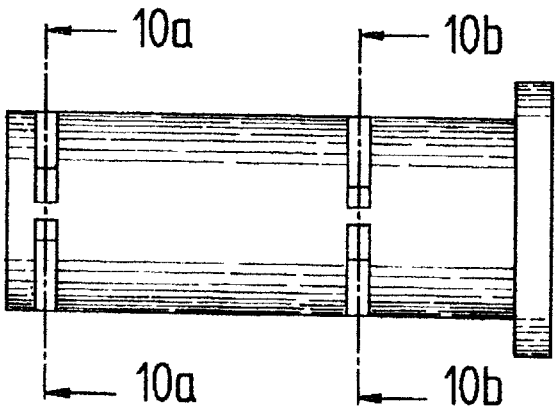
FIG. 10*s* is a side elevation view of the alternative internal stator of FIG. 10.
Figure 10A:
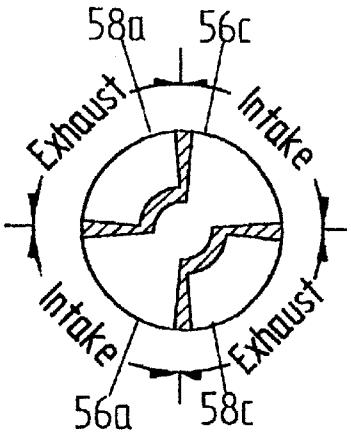
FIG. 10*a* is a sectional view taken along line 10*a*—10*a* of FIG. 10*s*.
Figure 10B:
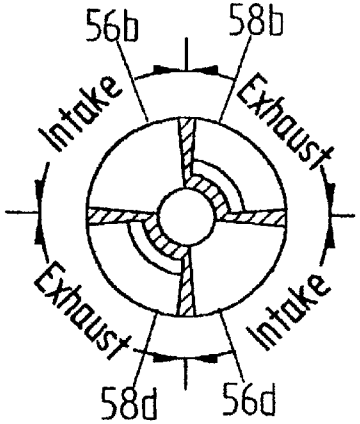
FIG. 10*b* is a sectional view taken along line 10*b*—10*b* of FIG. 10*s*.

In the operation of the device depicted in FIGS. 10*a*–10*b*, as the rotor assembly completes one revolution, each piston assembly end performs four strokes, which comprise two intake strokes alternated by two discharge strokes. As one end of one piston assembly performs an intake stroke, the other end of the same piston assembly performs a discharge stroke. In functioning as a motor-driven pump or compressor, the rotor assembly is made to rotate by coupling the end shaft to a driving means such as a motor (not shown). The pistons reciprocate in response to the action of cam followers on the protruding cam surfaces, while end openings 32*a* and 32*b* of the working cylinders alternately register with intake and discharge ports of the internal stator 50*a*, thus performing intake and discharge functions. Alternately, the rotary device employing the internal stator shown in FIG. 10 may function as a four-cycle fluid-driven motor or expander device. In such operating mode, a pressurized fluid is received in the axial intake channel 62 and subsequently routed to the operative ends of working cylinders 26*a* and 26*b*, thus transmitting an axial force through the piston heads and respective roller cam followers 82*a* and 82*b*. The tangential component of the reaction forces between the cam rollers and the protruding cam surfaces 18*a* and 18*b* is transmitted through the cam pin 86 in cam groove 42 to impart a torque on the rotor assembly, thus causing the rotation of the assembly. At the same time, reciprocation of the pistons results in discharging the depressurized fluid through channel 60 during the discharge phase of the cycle.

Figure 10C:
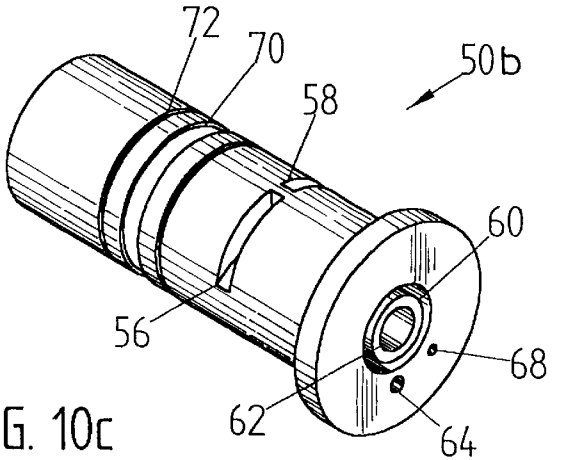
FIG. 10*c* is an isometric view of an alternative internal stator of the rotary power device of FIG. 1 employing the rotor-piston assembly of FIG. 3*a* and the external stator of FIG. 4*a*, the device operating as a compound four-cycle internal combustion engine or fluid compressor device.

Still another embodiment of the four-stroke rotary power device is one that serves as a four stroke compound internal combustion engine and as a fluid compressor. This is accomplished by replacing the rotor assembly 40 with a modified rotor assembly 40*a*. The modified rotor assembly comprises a circular array of working cylinders 26*b*, each of which communicates with the central bore through a respective end opening 32*b*. The rotor assembly further comprises a second circular array of working cylinders 26*a* communicating through axial end openings 33 with four circular arc channels 29*a*, 29*b*, 29*c* and 29*d* embedded in the adjacent front plate 14*a* of the external stator. Further, in this embodiment, the internal stator 50 is replaced with a modified internal stator 50*b*, as shown in FIG. 10*c*. The modified stator 50*b* comprises one intake port 56, one exhaust port 58 and an ignition port 66, each port communicating with end openings 32*b* in the circular array 26*b* of working cylinders. In operation, each working cylinders in the circular array 26*b* performs four strokes comprising intake, compression, power and discharge strokes as the rotor completes one revolution. In contrast, each working cylinders of the first set 26*a* function as a fluid compressor executing two fluid intake strokes alternated by two discharge strokes whereby axial end opening 33 alternately communicate with end plate intake passages 29*a* and 29*c* and discharge passages 29*b* and 29*d*.

Figure 10D:
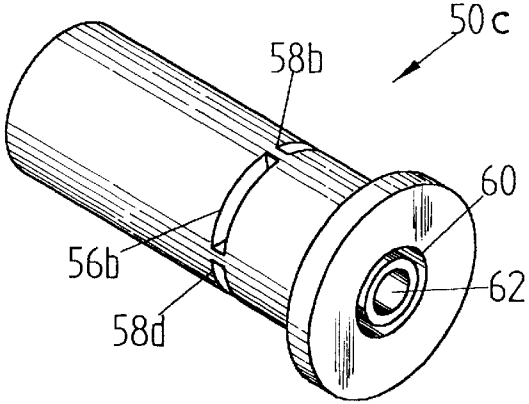
FIG. 10*d* is an isometric view of an alternative internal stator of the rotary power device of FIG. 1 employing the rotor-piston assembly of FIG. 3*a* and the external stator of FIG. 4*a*, the device operating as a four-cycle fluid-driven compressor device.
Figure 10E:
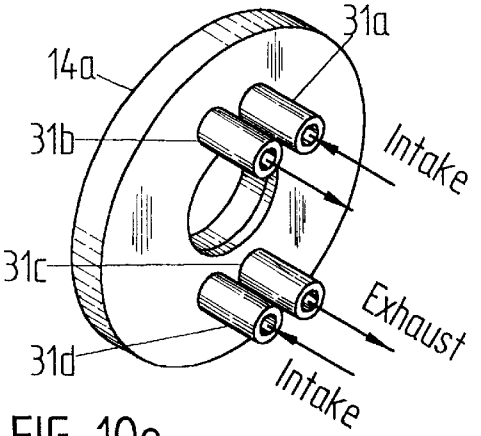
FIG. 10*e* is an isometric view of an alternative front end plate of the alternative external stator of FIG. 4*a* functioning as internal combustion-driven or fluid-driven compressor device.
Figure 10F:
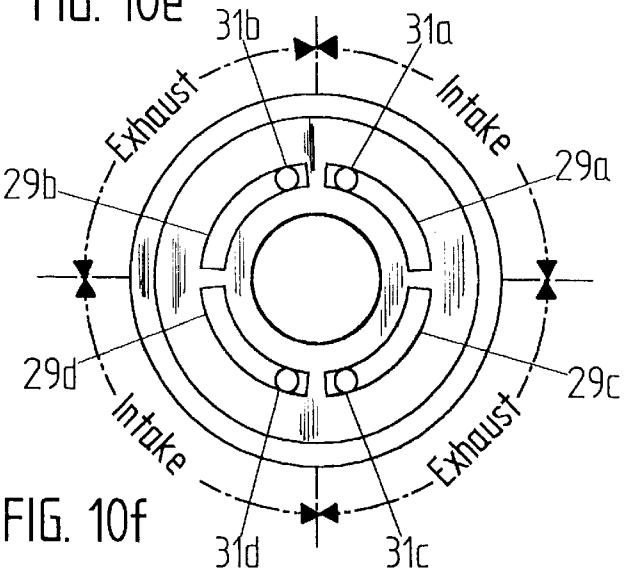
FIG. 10*f* is an end view of the alternative front end plate of FIG. 10*e*.

In addition to the above applications, the four-stroke rotary power device can be easily converted to serve as a four stroke fluid-driven compressor, pump or pressure exchanger device. In this application the external stator 20 is replaced with modified external stator 20*a*, as shown in FIG. 4*a*. Also, the rotor assembly 40 is replaced with the modified rotor assembly 40*a* of FIG. 3*a*. The modified rotor assembly comprises set of working cylinders 26*b* communicating with the central bore through respective end openings 32*b*. The rotor assembly further comprises a second set of working cylinders 26*a* communicating through axial end openings 33 with four circular arc channels 29*a*, 29*b*, 29*c* and 29*d* embedded in the adjacent front plate 14*a* of the external stator. Also, the internal stator 50 is replaced with internal stator 50*c*, as shown in FIG. 10*d*, which comprises two diametrically opposed intake ports 56*b* and 56*d* alternated by two diametrically opposed exhaust ports 58*b* and 58*d*, each port communicating with end openings 32*b* in one set 26*b* of working cylinders. In operation, a highly pressurized fluid is conveyed to one set of working cylinders, say 26*b*, through an internal stator axial intake channel 62, and is then discharged through an exhaust channel 60. A second weakly pressurized fluid is conveyed to the second set of working cylinders 26*a* through end plate ports 31*a* and 31*d* connected to respective intake channels 29*a* and 29*d* and is discharged through channels 29*b* and 29*c* connected to respective ports 31*b* and 31*c*. An alternative arrangement (not shown) is possible wherein the highly pressurized fluid is conveyed to the first set 26*a* of working cylinders and the weakly pressurized fluid is conveyed to the other set 26*b*. The highly pressurized net fluid forces in one set of working cylinders is transmitted through pistons and cam tracks to cause rotation of the rotor and the pressurization of the weakly pressurized fluid in the second set of working cylinders. In this embodiment, each working cylinder perfumes two intake strokes alternated by two exhaust strokes.

Figure 12:
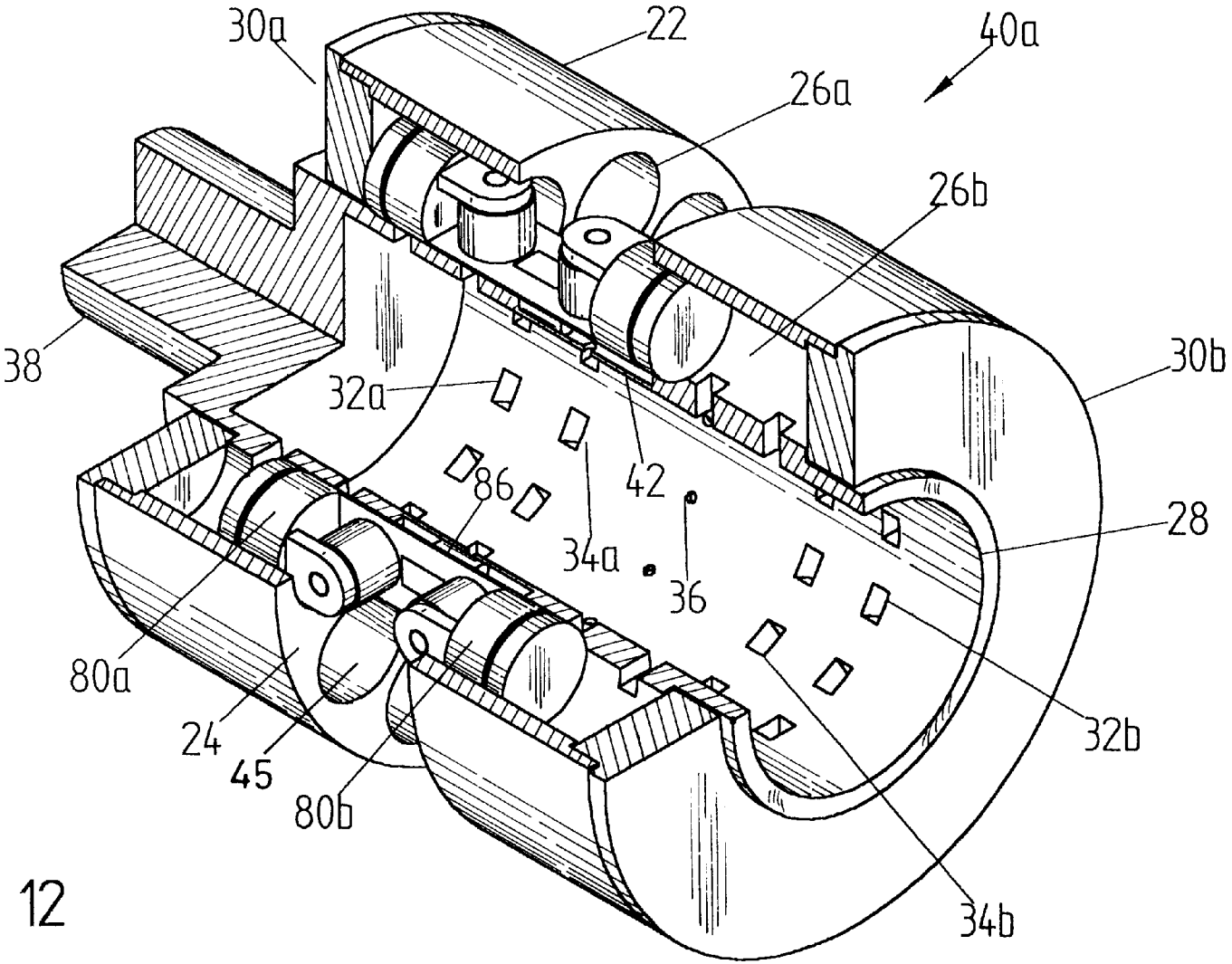
FIG. 12 is an isometric view of a rotor-piston assembly of the rotary power device of FIG. 11, the view having portion of rotor cut away for purposes of illustration.

Turning now to FIGS. 11–17, one finds an embodiment of the invention that can operate as a two-cycle internal combustion engine. The transformation of the four-cycle device previously disclosed to a two-cycle rotary internal combustion includes the following modifications. First, the two-cycle protruding cam 18*a* and 18*b* of FIG. 4, comprising two minima and two maxima points, is replaced with a one cycle cam track of FIG. 13 comprising one minimum point and one maximum. With this modification each end of a piston assembly performs two strokes when the rotary assembly completes one revolution. Secondly, unlike the four-cycle rotary assembly case in which the end openings 32*a* and 32*b* perform both intake and exhaust functions, the two stroke engine of FIG. 11 comprises an additional pair of radially inward medial openings 34*a* and 34*b*, as depicted in FIG. 12. These medial openings are used only for the exhaust function, and the radially inward end openings 32*a* and 32*b* are used solely for intake. Thirdly, the internal central stator 50 is replaced with a modified central stator 50*d* shown in FIG. 17.

Figure 16B:
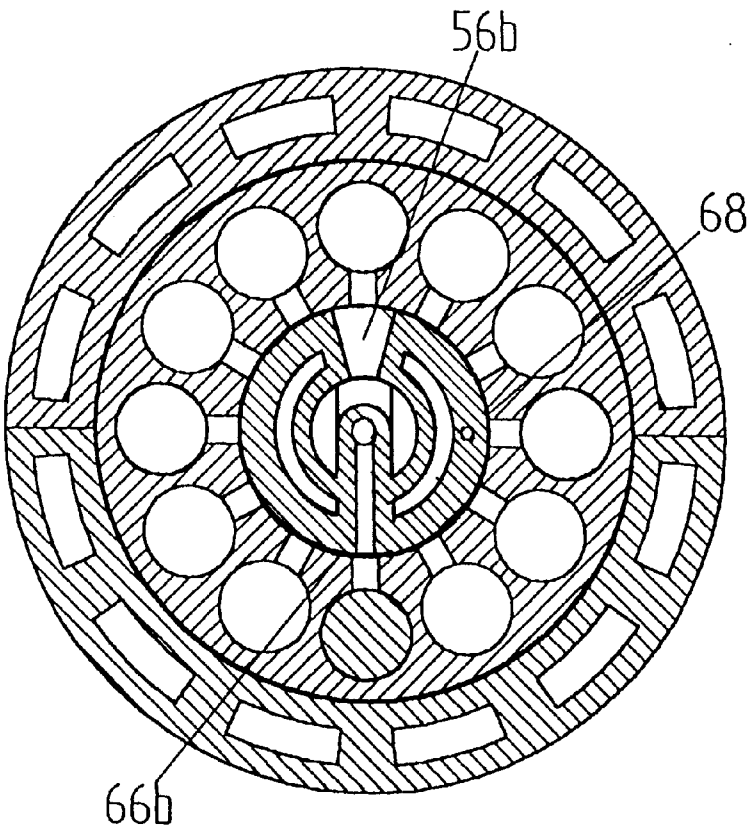
FIG. 16*b* is a sectional view taken along line 16*b*—16*b* of FIG. 14*s*.
Figure 16A:
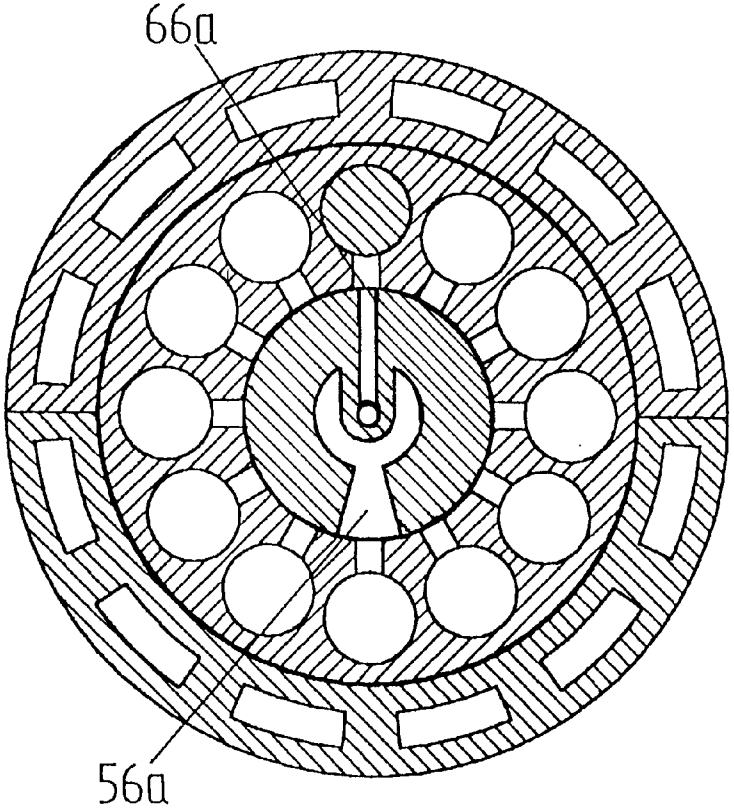
FIG. 16*a* is a sectional view taken along line 16*a*—16*a* of FIG. 14*s*.
Figure 17E:
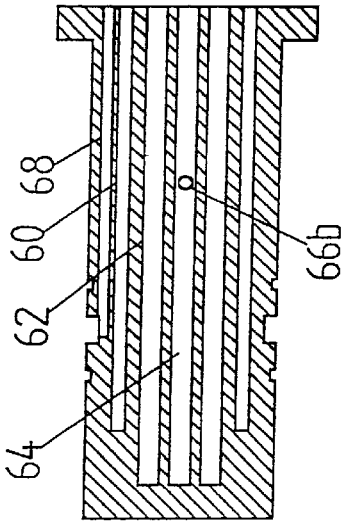
FIG. 17*e* is a section view taken along line 17*e*—17*e* of FIG. 17*s*.
Figure 17S:
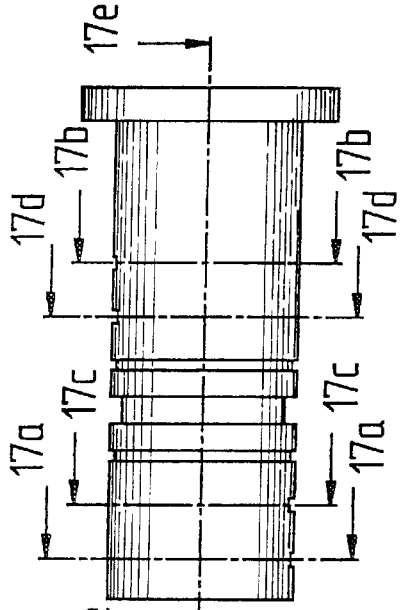
FIG. 17*s* is a side elevation view of the device of FIG. 17.
Figure 17B:
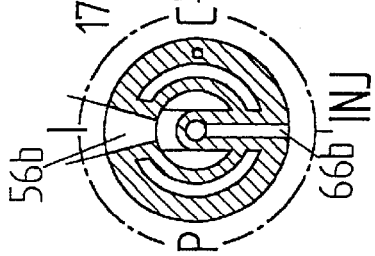
FIG. 17*b* is a section view taken along line 17*b*—17*b* of FIG. 17*s*
Figure 17D:
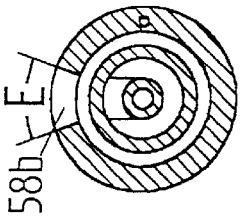
FIG. 17*d* is a section view taken along line 17*d*—17*d* of FIG. 17*s*
Figure 17C:
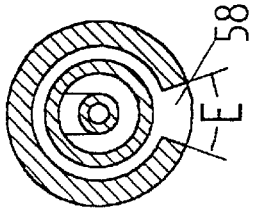
FIG. 17*c* is a section view taken along line 17*c*—17*c* of FIG. 17*s*
Figure 17A:
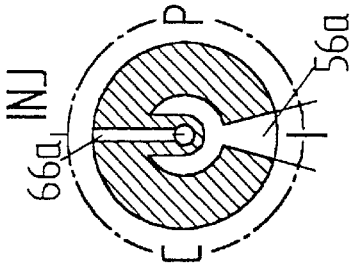
FIG. 17*a* is a section view taken along line 17*a*—17*a* of FIG. 17*s*.
Figure 17:
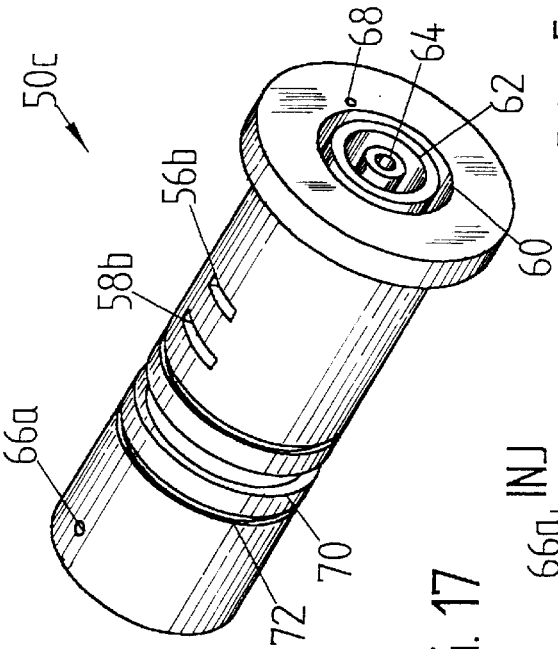
FIG. 17 is an isometric view of the internal stator of the rotary power device of FIG. 11.
Figure 19E:
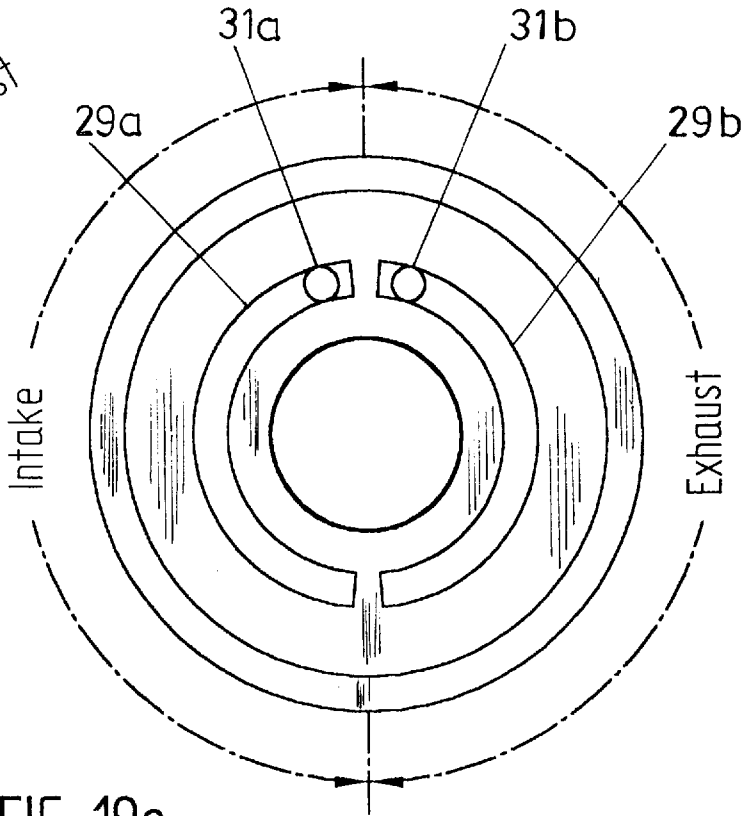
FIG. 19*e* is an end view of the front plate of FIG. 19.
Figure 19:
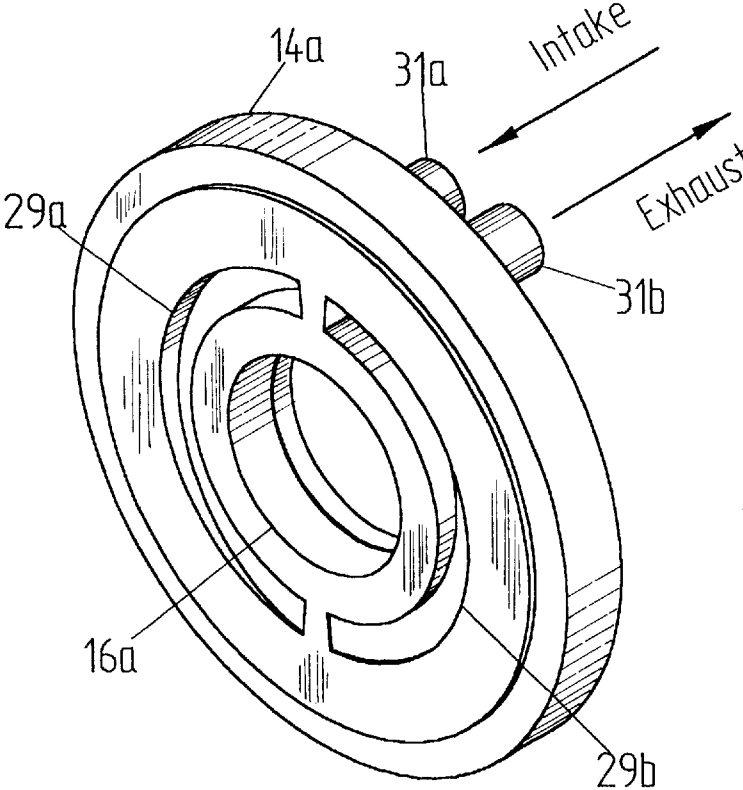
FIG. 19 is an isometric view of the front plate of the rotary power device of FIG. 11*a*.

The modified internal central stator 50*d* as shown in FIG. 17 for a two-cycle internal combustion engine is similar to the internal stator 50 used in the four-cycle engine except for the disposition and angular extent of the intake and exhaust ports. In the two-cycle internal stator 50*d*, a pair of axially spaced apart intake ports and discharge ports 56*a* and 58*a* communicate with corresponding aligned openings 32*a* and 34*a* of the first set 26*a* of working cylinders. Correspondingly, a pair of axially spaced apart intake and discharge ports 56*b* and 58*b* communicate with aligned openings 32*b* and 3*b* of the second set 26*b* of working cylinders. To allow for purging of combustion products in this so called scavenging process, the exhaust port is made to have a wider angular displacement so that is overlaps the axially adjacent intake port. Secondly, each pair of axially adjacent intake and discharge ports is disposed at 180° relative to the other pair. In addition, the ignition ports 66*a* and 66*b* of the four-cycle engine are replaced with injection ports 66*a* and 66*b* in the two-cycle engine. As depicted in FIG. 16*a* and 16*b*, an injection port 66*a* is disposed diagonally opposite to an intake port 56*a*, and similarly as injection port 66*b* is diagonally opposite its associated intake port 56*b*. Axial channels are provided, as in the four-cycle engine, to connect these ports to the exterior. Intake ports 56*a* and 56*b* may communicate with an annular axial channel 62 and exhaust ports 58*a* and 58*b* may communicate with an annular channel 60. Alternately, (not shown) the intake ports 56*a* and 56*b* may communicate with an annular axial channel 60 and the exhaust ports 58*a* and 58*b* may communicate with the annular axial channel 62. A common central axial channel 64 provides injection charges to injection ports 66*a* and 66*b*, respectively. The lubricating recess 70 receives lubricating cooling primary fluid through an axial channel 68, and ring seal recesses 72 are adapted to receive ring seals (not shown).

The principle of imparting torque on the rotor is the same as in the four-cycle case. The tangential components of the reaction contact forces between roller cam followers 82*a*, 82*b* and the protruding cam surfaces 18*a*, 18*b* are transmitted through the cam pin 86 on the groove cam 42 to provide a rotating moment to the rotor. The resulting rotation of the rotor causes the piston assemblies to reciprocate in their respective working cylinders. Because of the one-cycle cam profile, each end of the piston assembly performs two strokes as the rotor moves through a single complete revolution. Each stroke of a piston assembly comprises a predominantly compression stroke at one end and a predominantly power stroke at the opposing end. As shown in FIGS. 17*a*–17*d*, the exhaust phase is defined over an angular extent including a portion subsequent to the power stroke and another portion preceding the compression stroke, while the intake phase includes an angular extent overlapped by an exhaust phase.

The operation of a two-cycle power device as an internal combustion engine is illustrated with respect to the internal stator 50*d* by means of FIG. 17*a* through 17*d*. When one of the working cylinders approaches a minimum volume position, injection and auto-ignition occur through ports 66*a* and 66*b*. At the same time, the axially opposite working cylinder is approaching its maximum volume position whereby exhaust followed by purging of products of combustion by portion of the intake air takes place. In the purging operation, the intake port 56*a* and 56*b* overlaps with the respective exhaust port 58*a* and 58*b*. Because of the larger angular displacement of the discharge port, a portion of the intake air is used to displace leftover products of combustion in the so-called scavenging process while the remainder is used for compression.

In addition to the internal combustion engine embodiment discussed above, a two-cycle rotary power device of the invention can serve as a pump, compressor, fluid-driven motor or an expander device by replacing the central internal stator member with a stator of the sort shown in FIG. 18. The internal stator 50*e* depicted in FIGS. 18, 18*s*, 18*a* and 18*b* comprises one pair of axially spaced apart intake ports 56*a*, 56*b* communicating with the central intake channel 62, and a second pair of axially spaced apart discharge ports 58*a*, 58*b* communicating with an annular discharge channel 60. Alternatively, (not shown) the internal stator 50*d* may comprise one pair of axially displaced intake ports 56*a*, 56*b* communicating with an annular intake channel 60, and a second pair of axially displaced discharge ports 58*a*, 58*b* communicating with a central discharge channel 62. Each port is defined within 180° of angular displacement, and each angularly adjacent pair of intake and discharge ports forms a 180° phase angular relationship with respect to the other axially displaced pair. In functioning as a pump or compressor, the rotor assembly is made to rotate by coupling the end shaft 38 to a driving means such as a motor (not shown). The piston assemblies, in response to the action of roller cam followers on protruding cam surfaces, reciprocate while openings 32*a* and 32*b* in respective working cylinders alternatively register with corresponding intake ports (56*a*, 56*b*) and discharge ports (58*a*, 58*b*) of the internal stator 50*e*, thus performing intake and discharge functions. Each time the rotor completes a 180° angular displacement, each piston assembly completes one stroke, performing a simultaneous intake stroke in one circular array of working cylinders and a discharge stroke in the other array of working cylinders. In functioning as a fluid-driven motor, pressurized fluid received in the axial intake channel 62 is routed to respective ends of working cylinders to cause the reciprocation of the pistons assemblies 100 in respective working cylinders. At the same time, the action of the roller cam followers 82*a* and 82*b* on the protruding cam surfaces 18*a*, 18*b* imparts a torque on the rotor assembly. In the process, potion of the fluid pressure energy is converted into mechanical rotational energy through the shaft and another portion remains as residual energy in the discharging fluid.

Figure 11:
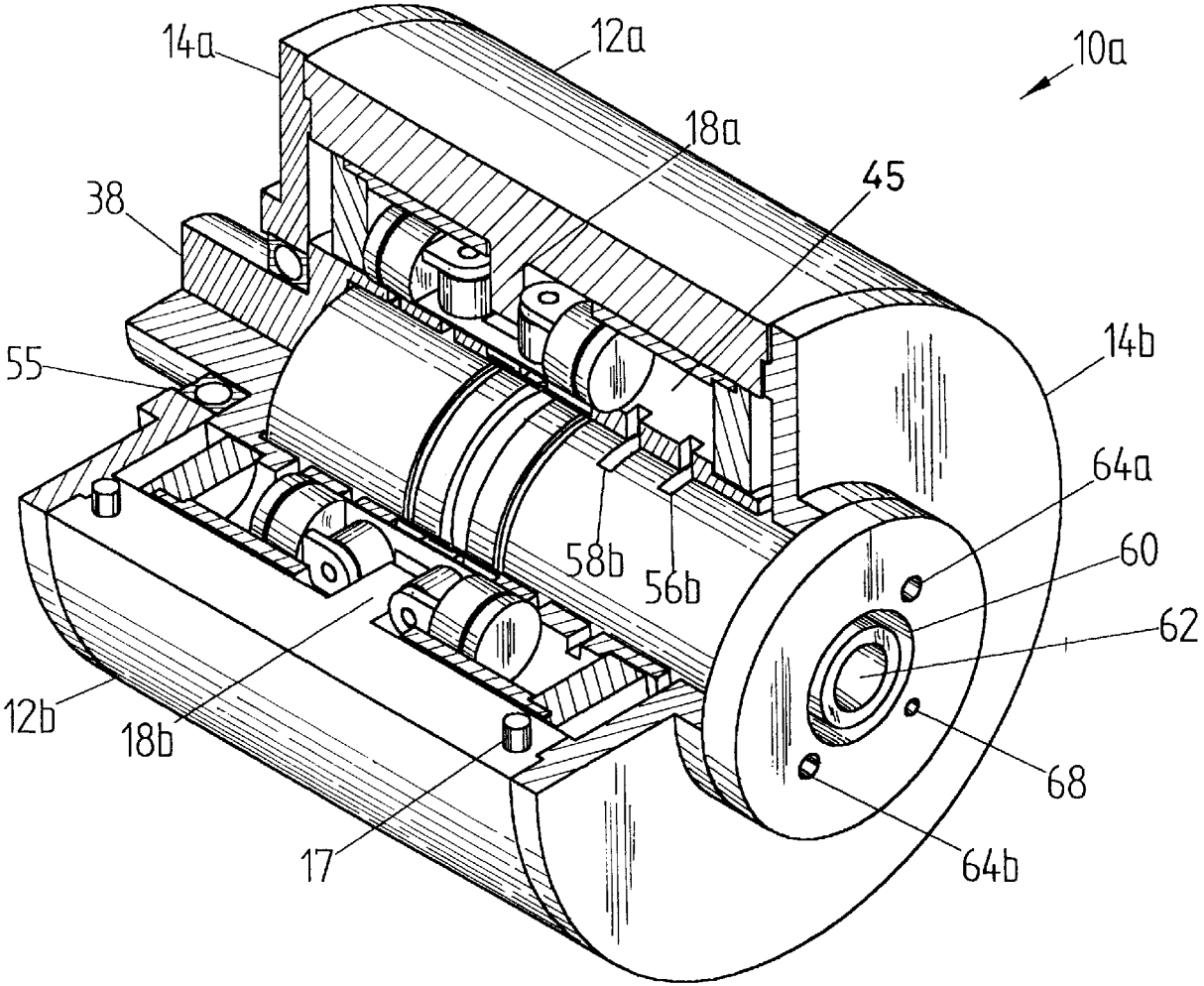
FIG. 11 is an isometric view of an alternative two-cycle rotary power device operating as an internal combustion engine, the view having an portion of the rotor and external casing cut away for purposes of illustration.
Figure 11A:
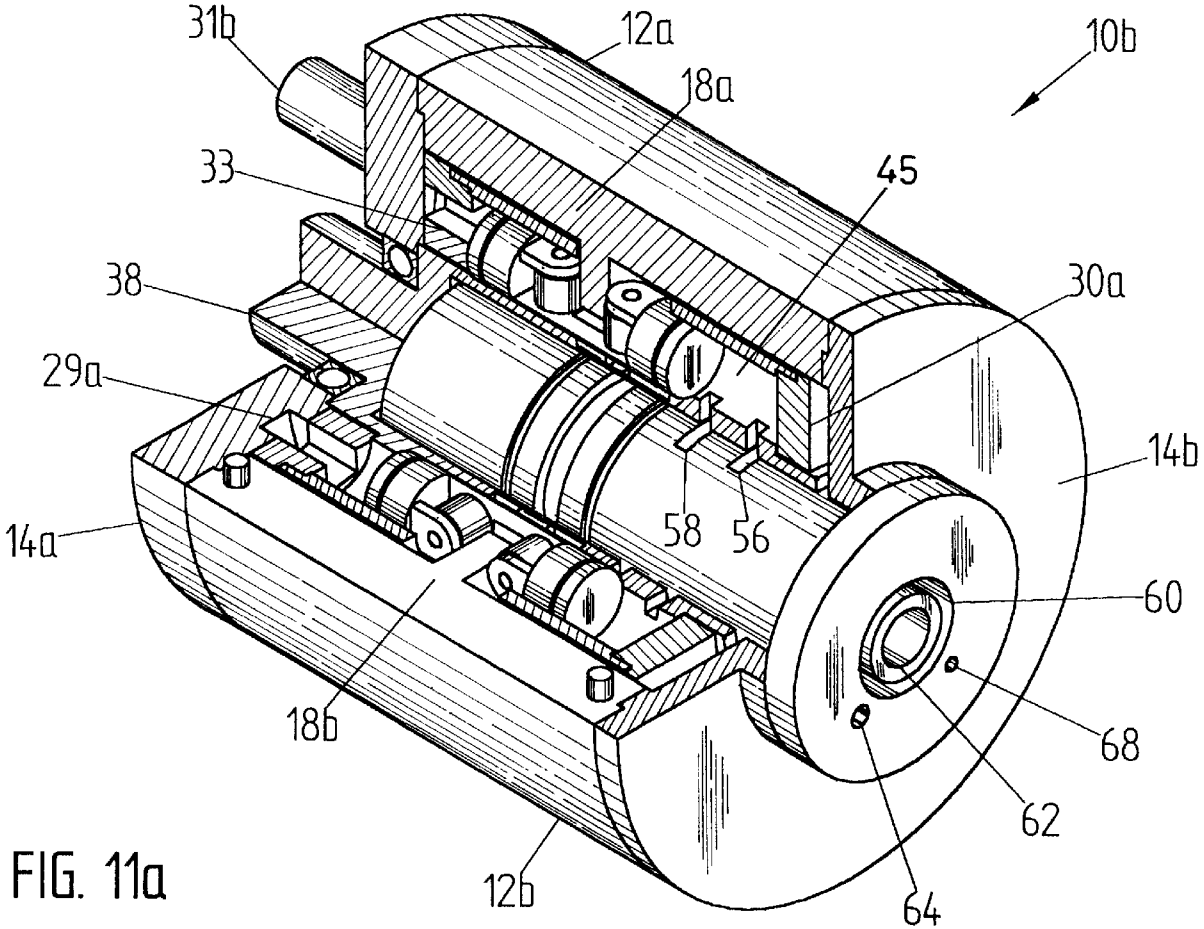
FIG. 11*a* is an isometric view of an alternative two-cycle rotary power device operating as a compound internal combustion engine or a compressor, the view having portions of the rotor and external casing cut away for purposes of illustration
Figure 12A:
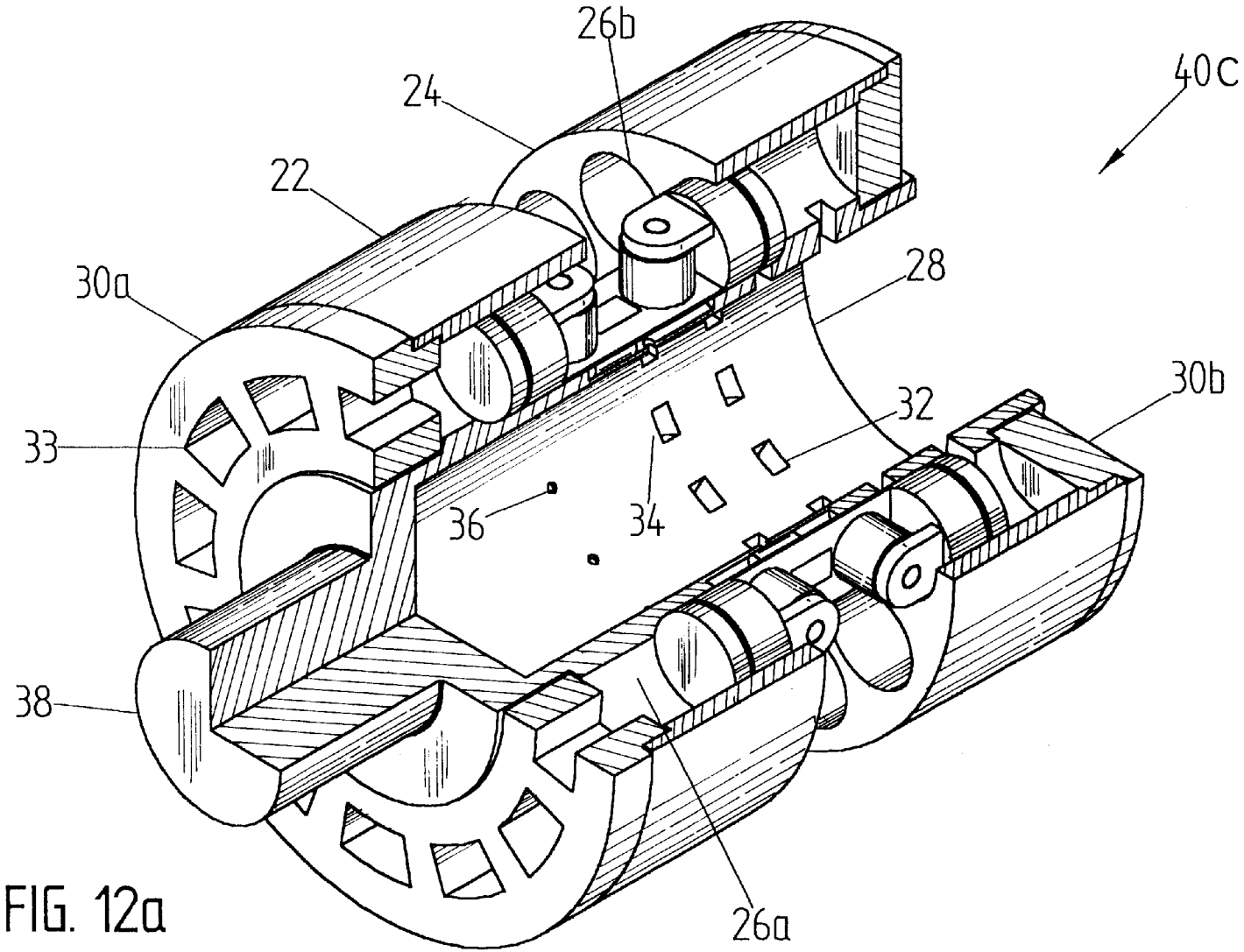
FIG. 12*a* is an isometric view of rotor-piston assembly of the rotary power device of FIG. 11*a*, the view having portions of the rotor cut away for purposes of illustration
Figure 13:
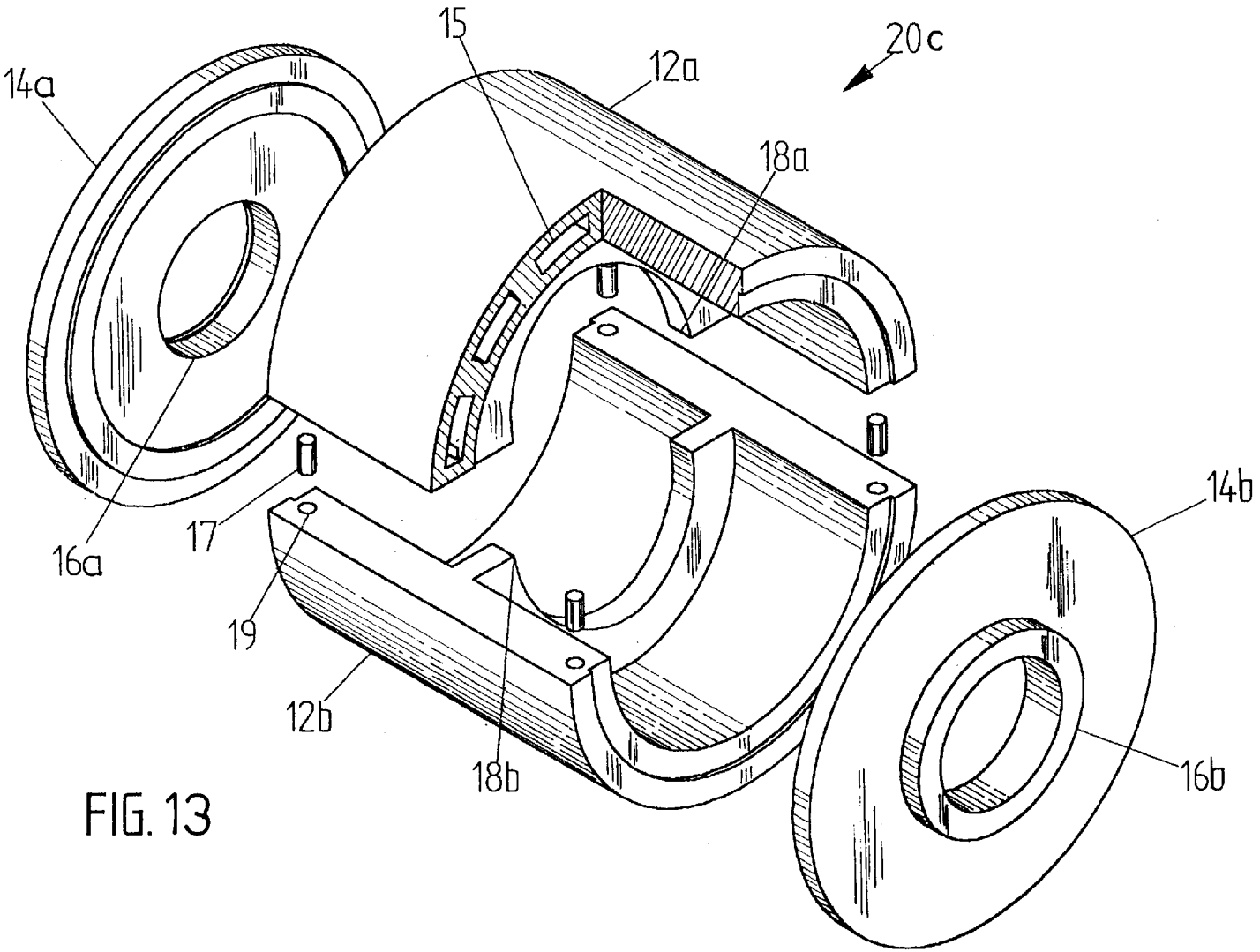
FIG. 13 is an exploded isometric view of an alternative cam and external stator for a two-cycle power device, the view having a portion cut away for purposes of illustration.
Figure 13A:
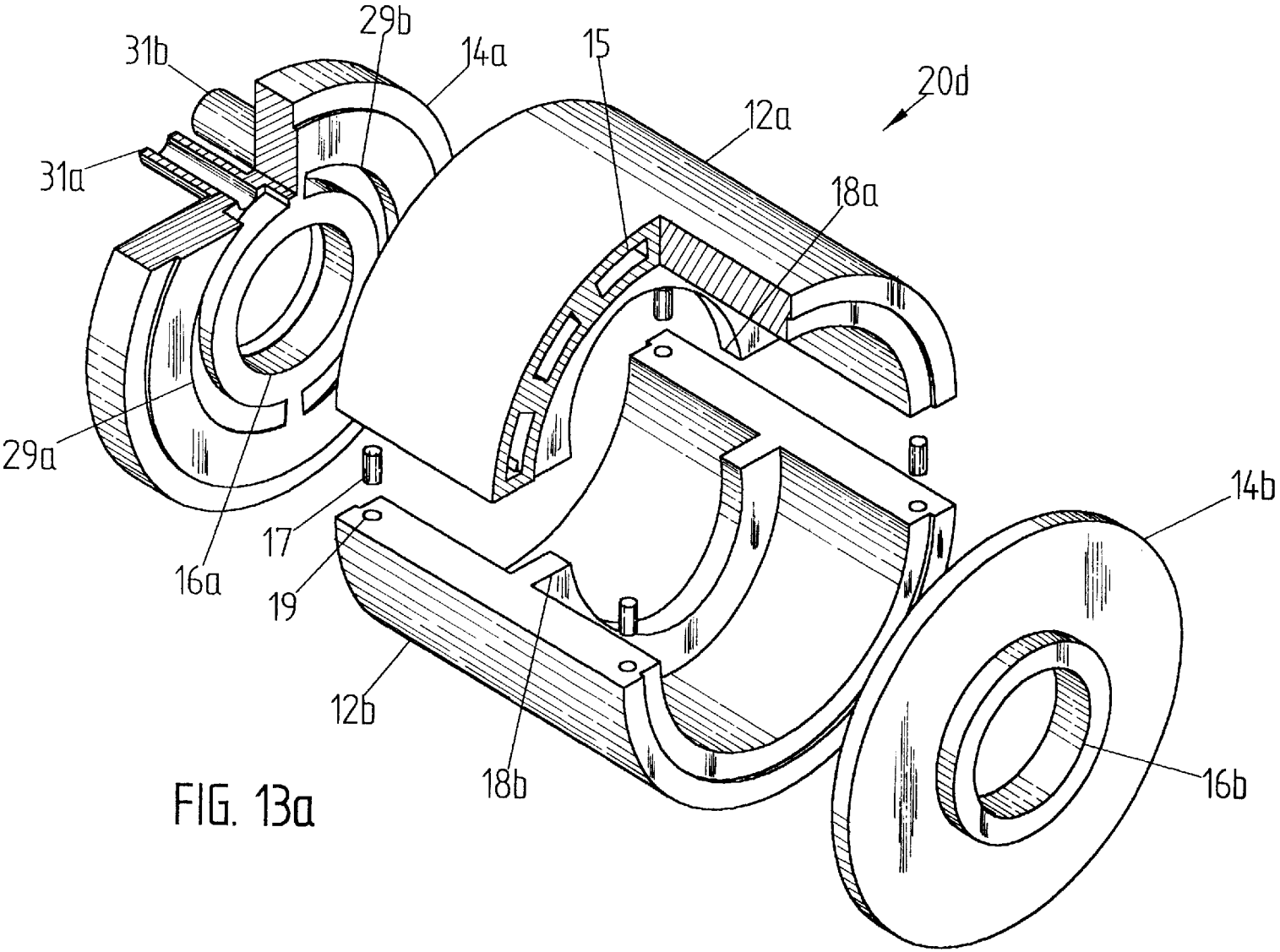
FIG. 13*a* is an exploded isometric view of an alternative cam and external stator for a two-cycle power device, the view having a portion cut away for purposes of illustration.
Figure 14:
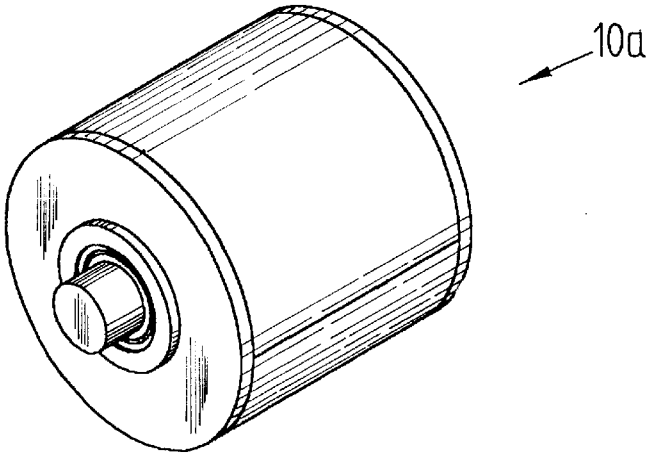
FIG. 14 is an isometric view of the rotary power device of FIG. 11.
Figure 14S:
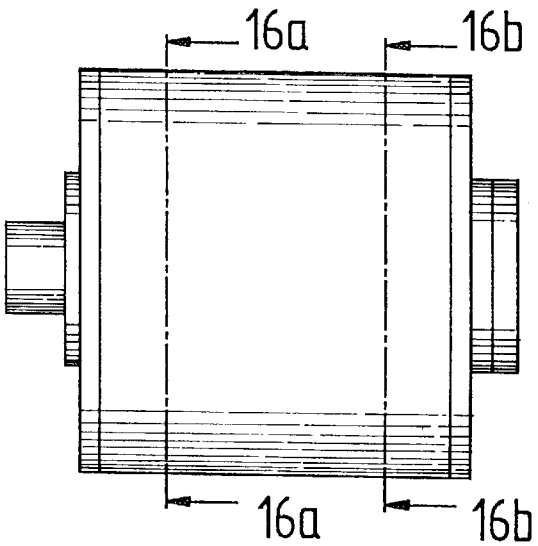
FIG. 14*s* is a side elevation view of FIG. 14.
Figure 14E:
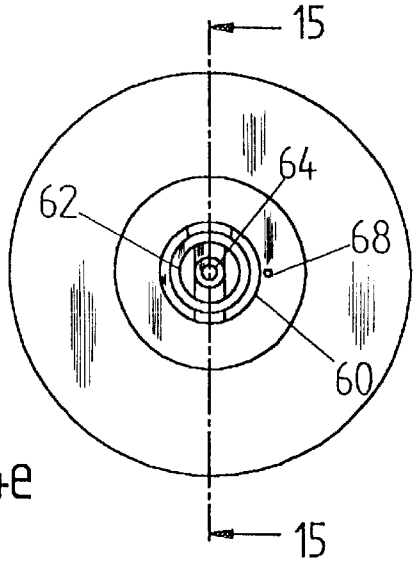
FIG. 14*e* is an end view of the rotary power device of FIG. 14.
Figure 15:
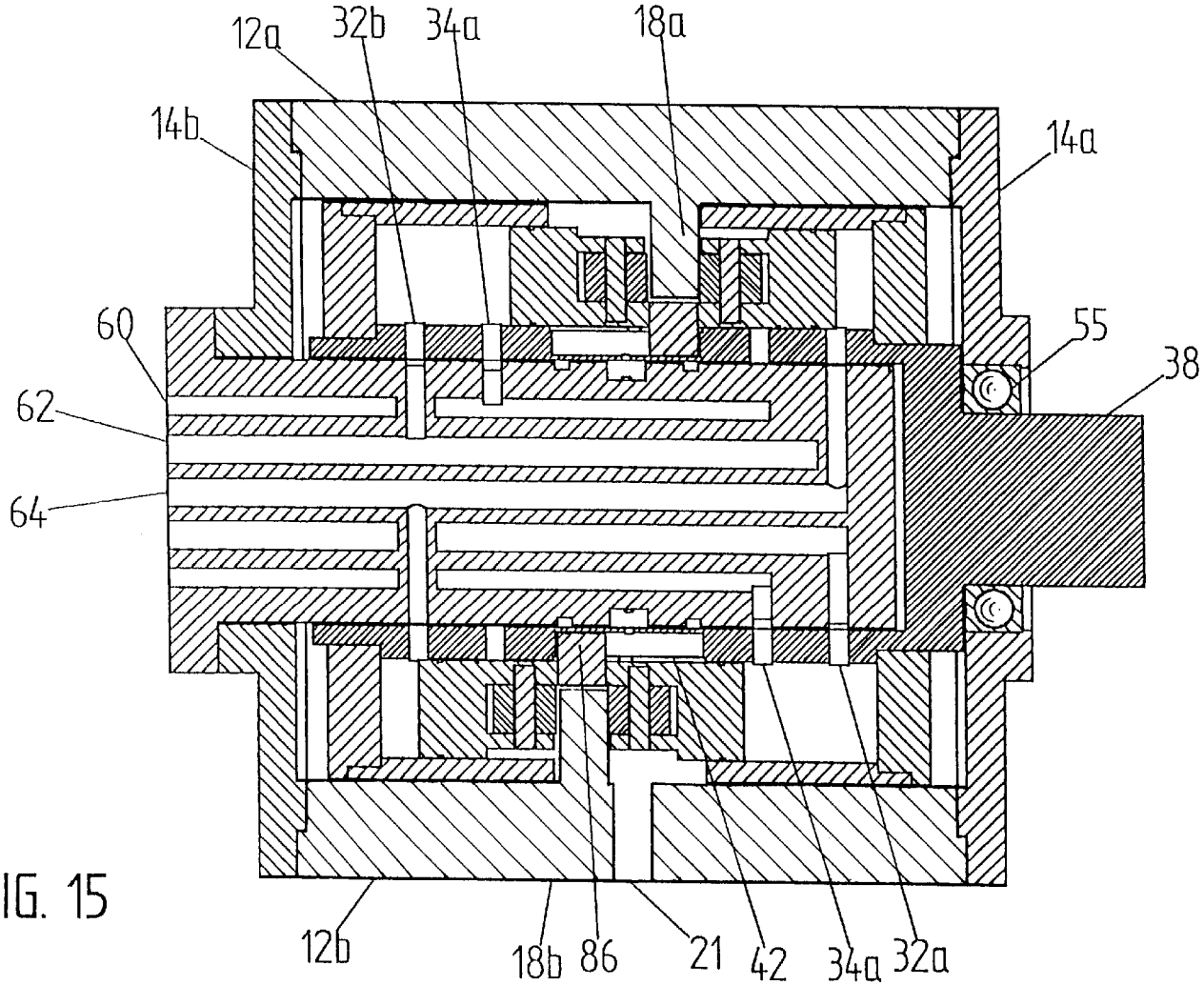
FIG. 15 is a sectional view taken along line 15—15 of FIG. 14*e*.
Figure 20A:
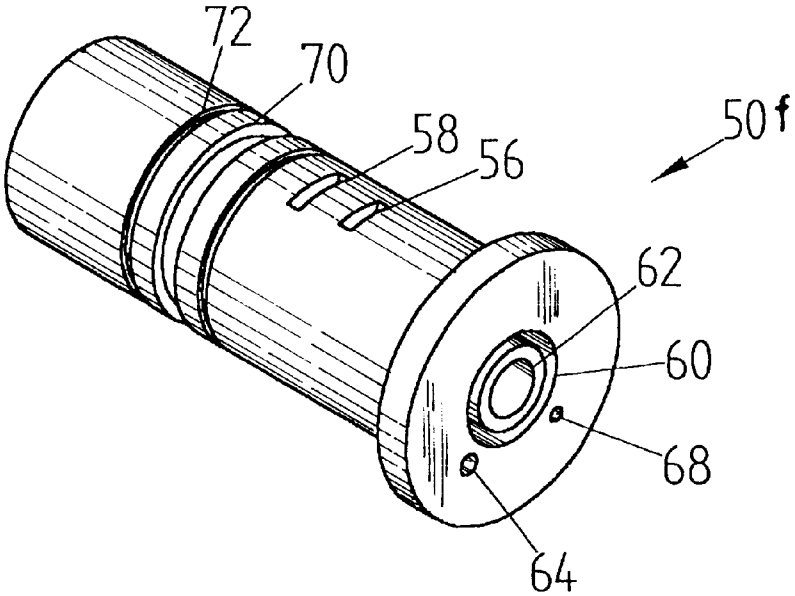
FIG. 20*a* is an alternative isometric view of an internal stator of the rotary power device of FIG. 11*a*, the device operating a compound two-cycle compressor and internal combustion engine.

Still another embodiment of the present invention is a rotary power device that can serve as a two-cycle compound internal combustion engine as shown in FIGS. 11*a* and 12*a*. In this embodiment a first set of working cylinders 26*a* communicates with the exterior through axial end opening 33 within the working cylinders. Each end opening 33 alternately communicates with semicircular intake and discharge channels 29*a* and 29*b*. These channels are cut into the inner face of the front plate 14*a*, and each channel has a respective intake and discharge port 31*a* and 31*b*. The second set of working cylinders 26*b* communicates with the internal stator 50*f*, as shown in FIG. 20*a*, through radial openings 32, 34 and functions as a two-cycle internal combustion engine while the first set of working cylinders 26*a* serve as a two-cycle compressor.

Figure 20B:
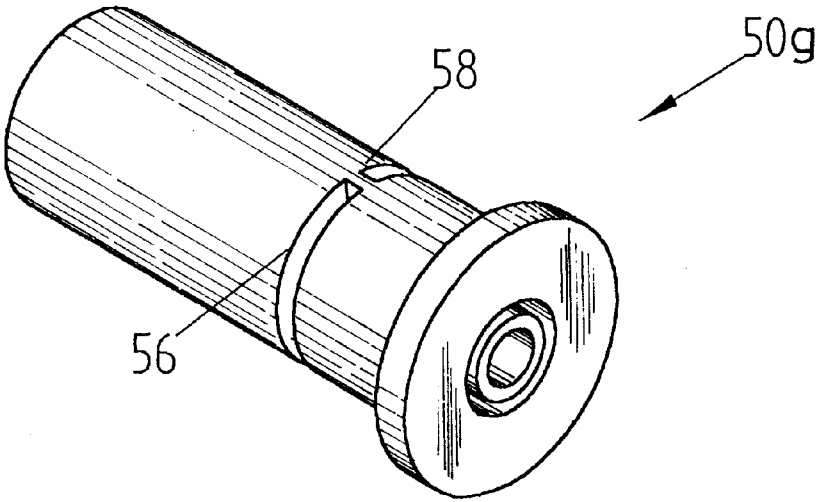
FIG. 20*b* is an alternative isometric view of an internal stator of the rotary power device of FIG. 11*a*, the device operating as fluid driven compressor.

Alternatively, the above device can serve as a two-cycle fluid-driven compressor by replacement of the internal stator 50*f* with another internal stator 50*g* shown in FIG. 20*b*. In this case, a first array of working cylinders 26*a* communicates with the exterior though axial end opening 33 within the working cylinders. Each end opening 33 alternately communicates with semicircular intake and discharge channels 29*a* and 29*b*. The second array of working cylinders 26*b* comprises respective end radial openings 32 that alternately register with an intake port 56 and a discharge port 58 of the internal stator 50*g*. In functioning as a fluid-driven compressor, a higher pressure fluid supplied to one set of working cylinders may be used to compress or pump a second fluid of lower pressure supplied to the second set of working cylinders.

As will be understood by those skilled in the art, various embodiments other than those described in detail in the specification are possible without departing from the scope of the invention will occur to those skilled in the art. It is, therefore, to be understood that the invention is to be limited only by the appended claims.

What is claimed is:

1. An axial piston rotary power device comprising a stator portion and a rotor portion, the rotor portion comprising a rotatable shaft extending along an axis of the device, the stator portion comprising:

an external stator portion defining a generally cylindrical interior; the external stator portion comprising a middle portion, a back plate portion forming one of two ends of the generally cylindrical interior, and a front plate portion forming the second end of the generally cylindrical interior, the front plate portion having a central throughhole within which the rotatable shaft is journaled;

a cylindrical internal stator portion projecting from the back plate portion into the cylindrical interior along the axis of the device so as to define an annular space extending between the internal and external stator portions, the internal stator portion having a plurality of passageways formed therein, at least one of the passageways comprising an inlet passageway, at least one of the passageways comprising an exhaust passageway, each of the passageways comprising a channel parallel to the axis, at least two of the channels communicating with at least one respective radial port formed in the internal stator portion at a respective selected axial position; and an axially undulating guide surface extending into the annular space from the middle portion of the external stator portion;

the rotor portion further comprising:

a cylindrical block fixedly attached to the shaft, the block rotatable within the annular space between the internal stator portion and the external stator portion, the block comprising a medial annular recess for receiving the axially undulating guide surface, the block comprising a central cylindrical bore for receiving the internal stator, the block further comprising a selected number of cylindrical cavities parallel to the axis of the device and spaced apart therefrom by a single selected radial distance, each cavity comprising an axially spaced pair of working cylinders, each working cylinder having a respective medial end communicating with the annular recess and a respective closeable outer end adjacent a respective one of the front plate and back plate portions of the external stator portion, at least one working cylinder in each pair thereof having a radially inwardly directed end opening adjacent the respective outer end thereof, each of the end openings communicating with the central cylindrical bore at a selected axial position; and the selected number of piston assemblies, each piston assembly slidably received in a respective one of the cylindrical cavities; each piston assembly having a respective piston head at each of two ends thereof and a respective middle portion extending between the two piston heads, each piston assembly comprising at least one respective pair of rotatable roller cam followers for following the axially undulating cam track surface, each piston assembly further comprising a respective cam follower pin for slidably engaging a respective axial groove formed in a wall of the respective cylindrical cavity.

2. The axial piston rotary power device of claim 1 wherein the axially undulating guide surface comprises a protruding portion of an inner surface of the middle portion of the external stator.

3. The axial piston rotary power device of claim 1 wherein the axially undulating guide surface comprises two separate portions attached to each other along a line extending diagonally across the cylindrical block.

4. The axial piston rotary power device of claim 1 wherein:

the axially undulating cam surface comprises a first pair of points at which the surface is a maximum distance from the back plate and a second pair of points at which the surface is a minimum distance therefrom;

the first of each pair of working cylinders has a respective first radially inwardly directed end opening adjacent a respective outer end of the respective first cylinder, each of the first end openings communicating with the central cylindrical bore at a first selected axial position;

the second of each pair of working cylinders has a respective second radially inwardly directed end opening adjacent a respective outer end of the respective second cylinder, each of the second end openings communicating with the central cylindrical bore at a second selected axial position;

the at least one inlet passageway comprises at least two inlet ports, each of the first and second end openings communicating exactly once with one of the two inlet ports during the course of each rotation of the block;

the at least one exhaust passageway comprises at least two exhaust ports, each of the first and second end openings communicating exactly once with one of the two exhaust ports during the course of each rotation of the block; and the plurality of passageways further comprises two ignition passageways, a first of the ignition passageways comprising a first ignition port at the first selected axial position, the first ignition port communication with each first end opening exactly once during each rotation of the block, the second of the ignition passageways comprising a second ignition port at the second selected axial position, the second ignition port communicating with each second end opening exactly once during each rotation of the block, wherein each of the ignition ports comprises means for receiving a respective igniter;

whereby the axial piston rotary power device is adapted to function as a four-cycle internal combustion engine.

5. The four-cycle rotary power device of claim 4 wherein the passageways comprise exactly one inlet passageway and exactly one exhaust passageway, one of the inlet and exhaust passageways comprising an axial channel, the other of the inlet and the exhaust passageways comprising an annular channel disposed about the axial channel.

6. The four-cycle rotary power device of claim 4 wherein the means for receiving an igniter comprises a threaded region of the respective ignition port.

7. The axial piston rotary power device of claim 1 wherein the axially undulating guide surface comprises a first pair of points at which the surface is a maximum distance from the back plate and a second pair of points at which the surface is a minimum distance therefrom;

the first of each pair of working cylinders comprises a respective first radially inwardly directed end opening adjacent a respective outer end of the respective first cylinder, each of the first end openings communicating with the central cylindrical bore at a first selected axial position;

the second of each pair of working cylinders has a respective second radially inwardly directed end opening adjacent a respective counter end of the respective second cylinder, each of the second end openings communicating with the central cylindrical bore at a second selected axial position;

the at least one inlet passageway comprises first and second diagonally opposed radial inlet ports at the first selected axial position, each of the first and second radial inlet ports communicating with each first end opening exactly once during each rotation of the block, the at least one inlet passageway further comprising third and fourth diagonally opposed radial inlet ports at the second selected axial position, each of the third and fourth radial inlet ports communicating with each second end opening exactly once during each rotation of the block; and the at least one exhaust passageway comprises first and second diagonally opposed exhaust ports at the first selected axial position, each of the first and second exhaust ports communicating with each first end opening exactly once during each rotation of the block, the at least one exhaust passageway further comprising third and fourth diagonally opposed exhaust ports at the second selected axial position, each of the third and fourth exhaust ports communicating with each second end opening exactly once during each rotation of the block;

wherein the axial piston rotary power device is adapted to function as one of a four-cycle pump, a four-cycle compressor, a four-cycle fluid-driven compressor and a four-cycle fluid-driven motor.

8. The four-cycle rotary power device of claim 7 wherein the passageways comprise exactly one inlet passageway and exactly one exhaust passageway, one of the inlet and exhaust passageways comprising an axial channel, the other of the inlet and the exhaust passageways comprising an annular channel disposed about the axial channel.

9. The axial piston rotary power device of claim 1 wherein the axially undulating cam surface comprises a first pair of points at which the surface is a maximum distance from the back plate portion and a second pair of points at which the surface is a minimum distance therefrom;

the first of each pair of working cylinders comprises a respective radially inwardly directed end opening adjacent one of the two end plate portions, each of the radially inwardly directed end openings communicating with the central cylindrical bore at the selected axial position;

the second of each pair of working cylinders comprises a respective axial end opening communicating with the second of the two end plate portions;

the at least one inlet passageway comprises a pair of diagonally opposed radial inlet ports, each of the radial inlet ports communicating with each of the radially inwardly directed end openings exactly once during each rotation of the block;

the at least once exhaust passageway comprises a pair of diagonally opposed radial exhaust ports, each of the radial exhaust ports communicating with each of the radially inwardly directed end openings exactly once during each rotation of the block;

the plurality of passageways further comprises one ignition port for receiving an igniter, the ignition port communicating with each radially inwardly directed end opening exactly once during each rotation of the block; and wherein the second end plate portion further comprises:

two diagonally opposed fluid intake passageways, each of which communicates with each of the axial end openings exactly once during each rotation of the block; and two diagonally opposed fluid exhaust passageways, each of which communicates with each axial end opening exactly once during each rotation of the block;

whereby the axial piston rotary power device is adapted to function as a compound four-cycle internal combustion engine driving a fluid compressor.

10. The axial piston rotary device of claim 9 wherein the passageways in the second end plate portion comprise a first and a second diagonally opposed circular arc intake passageway alternated by a third and a fourth diagonally opposed circular arc exhaust passageway, each of the first through fourth circular arc passageways comprising a respective groove formed in the inner face of the second end plate portion, each of the first through fourth circular arc passageways connected to a respective port.

11. The axial piston rotary power device of claim 1 wherein the axially undulating guide surface comprises a first pair of points at which the surface is a maximum distance from the back plate and a second pair of points at which the surface is a minimum distance therefrom;

a first of each pair of working cylinders comprises a respective radially inwardly directed end opening adjacent a first of the end plate portions, each of the radially directed end openings communicating with the central cylindrical bore at the selected axial position;

the second of each pair of working cylinders comprises a respective axial end opening extending through its closeable outer end, each axial end opening communicating with a passage in the second end plate portion;

the at least one inlet passageway comprises a pair of diagonally opposed radial inlet ports, each of the inlet ports communicating with each of the radially directed end openings exactly once during each rotation of the block;

the at least one exhaust passageway comprises a pair of diagonally opposed radial exhaust ports, each of the exhaust ports communicating with each of the radially inwardly directed end openings exactly once during each rotation of the block; and wherein the second end plate portion comprises:

two diagonally opposed fluid intake passageways, each fluid intake passageway communicating with each axial end opening exactly once during each rotation of the block; and two diagonally opposed fluid exhaust passageways, each of the fluid exhaust passageways communicating with each axial end opening exactly once during each rotation of the block;

whereby the axial piston rotary power device is adapted to function as one of a four-cycle fluid-driven compressor and a four-cycle fluid-driven pump.

12. The axial piston rotary device of claim 11 wherein:

the passageways in the second end plate portion of the external stator comprise first and second diagonally opposed circular arc intake passages alternated by third and fourth diagonally opposed circular arc exhaust passages;

each of the circular arc passageways comprises a respective groove formed in an inner face of the second end plate portion of the external stator; and each circular arc passageway is connected to a respective port.

13. The axial piston rotary power device of claim 1 wherein:

the axially undulating guide surface comprises exactly one point at which the surface is a maximum distance from the back plate portion and exactly one point at which the surface is a minimum distance therefrom;

each of the cylindrical cavities comprises four axially spaced radially inwardly directed openings, each of the openings communicating with the central cylindrical bore at a corresponding one of four selected axial positions, wherein the first and the fourth of the axial positions are respectively adjacent the two end plate portions of the external stator, wherein the second axial position is intermediate the first and the third positions and wherein the third position is intermediate the second and the fourth positions;

the at least one inlet passageway comprises an air inlet passageway comprising a first radial air inlet port at the first of the four selected axial positions, the first radial air inlet port communicating with the first radial opening in each cylindrical cavity exactly once during each rotation of the block, the at least one air inlet passageway further comprising a second radial air inlet port at the fourth selected axial position, the second radial air inlet port communicating with the fourth of the radial openings in each cylindrical cavity exactly once during each rotation of the block;

the at least one exhaust passageway comprises a first exhaust port at the second axial position, the first exhaust port communicating with the second radial opening in each cylindrical cavity exactly once during each rotation of the block, and a second exhaust port at the third selected axial position, the second exhaust port communicating with the third radial opening in each cylindrical cavity exactly once during each rotation of the block; and the plurality of passageways further comprises at least one fuel injection passageway comprising at least one fuel injection channel and at least two fuel injection ports, a first fuel injection port disposed at the first selected axial position diagonally opposite the first inlet port, the first fuel injection port communicating with each first radial opening exactly once during each rotation of the block, the second of the fuel injection passageways comprising a second fuel injection port disposed at the fourth axial position diagonally opposite the second inlet port, the second fuel injection port communicating with each fourth radial opening exactly once during each rotation of the block;

whereby the axial piston rotary power device is adapted to function as a two-cycle internal combustion engine.

14. The two-cycle rotary power device of claim 13 comprising exactly one inlet passageway, exactly one exhaust passageway and one axial fuel injection passageway, each of the inlet and exhaust passageways comprising respective channels disposed about the axial fuel injection channel.

15. The axial piston rotary power device of claim 1 wherein:

the axially undulating guide surface comprises exactly one point at which the surface is a maximum distance from the back plate portion and exactly one point at which the surface is a minimum distance therefrom;

each working cylinder in each pair thereof comprises a respective radially inwardly directed opening adjacent a respective outer end thereof, each of the radially inwardly directed openings communicating with the central cylindrical bore at a respective one of a first and a second selected axial positions;

the at least one inlet passageway comprises a first radial inlet port at the first selected axial position, the first radial inlet port communicating with the respective radially inwardly directed opening in a first of each pair of working cylinders exactly once during each rotation of the block, the at least one inlet passageway further comprising a second radial inlet port at the second selected axial position, the second radial inlet port communicating with the respective radially inwardly directed opening in the second of each pair of working cylinders exactly once during each rotation of the block; and the at least one exhaust passageway comprises a first exhaust port at the first selected axial position, the first exhaust port communicating with the respective radially directed opening in each of the first of each pair of working cylinders exactly once during each rotation of the block, the at least one exhaust passageway further comprising a second exhaust port at the second selected axial position, the second exhaust port communicating with the respective radially directed opening in each of the second of each pair of working cylinders exactly once during each rotation of the block;

whereby the axial piston rotary power device is adapted to function as one of a two-cycle pump, a two-cycle compressor, and a two-cycle fluid-driven motor.

16. The two-cycle rotary power device of claim 15 comprising a single inlet passageway and a single exhaust passageway, one of the inlet and exhaust passageways comprising an axial channel, the other of the inlet and the exhaust passageways comprising an annular channel disposed about the axial channel.

17. The axial piston rotary power device of claim 1 wherein:

the axially undulating guide surface comprises exactly one point at which the surface is a maximum distance from the back plate and exactly one point at which the surface is a minimum distance therefrom;

the first of each pair of working cylinders comprises a respective first radially inwardly directed end opening adjacent the outer end thereof, each of the first radially inwardly directed openings communicating with the central cylindrical bore at a first selected axial position;

the first of each pair of working cylinders further comprises a respective second radially inwardly directed opening axially spaced apart from the respective first radially inwardly directed end opening, wherein each of the second radially inwardly directed end openings communicates with the central cylindrical bore at a second selected axial position more distal from a first of the two end plate portions than is the first selected axial position;

the second of each pair of working cylinders comprises a respective axial end opening extending through the closeable outer end thereof, each of the axial end openings communicating with at least the second of the two end plate portions of the external stator;

the at least one inlet passageway comprises a first radial air inlet port at the first selected axial position, the first radial air inlet port communicating with each of the first radially inwardly directed openings exactly once during each rotation of the block;

the at least one exhaust passageway comprises a first exhaust port at the second selected axial position, the first exhaust port communicating with each of the second radially inwardly directed openings exactly once during each rotation of the block;

the plurality of passageways further comprises one fuel injection passageway comprising a fuel injection port disposed at the first selected axial position diagonally opposite the first inlet port, said injection port communicating with each of the first radial inwardly directed openings exactly once during each rotation of the block; and wherein the second end plate portion further comprises:

a fluid intake passageway communicating with each axial end opening exactly once during each rotation of the block; and a fluid exhaust passageway communicating with each axial end opening exactly once during each rotation of the block;

whereby the axial piston rotary power device is adapted to function as a compound two-cycle internal combustion engine and fluid compressor.

18. The axial piston rotary device of claim 17 wherein the fluid intake and fluid exhaust passageways comprise semicircular grooves formed in an inner face of the second end plate portion of the external stator.

19. The axial piston rotary power device of claim 1 wherein:

the axially undulating guide surface comprises exactly one point at which the surface is a maximum distance from the back plate and exactly one point at which the surface is a minimum distance therefrom;

the first of each pair of working cylinders comprises a respective radially inwardly directed opening adjacent a first of the two end plate portions of the external stator, each of the radially inwardly directed openings communicating with the central cylindrical bore at a selected axial position;

the second of each pair of working cylinders comprises a respective axial end opening extending through the closeable outer end thereof, each axial end opening communicating with the second end plate portion of the external stator;

the at least one inlet passageway comprises a radial inlet port at the selected axial position, the radial inlet port communicating with each of the radially inwardly directed openings exactly once during each rotation of the block;

the at least one exhaust passageway comprises an exhaust port at the selected axial position, the exhaust port communicating with each of the radially inwardly directed openings exactly once during each rotation of the block; and wherein the second end plate portion further comprises:

at least one fluid intake passageway communicating with each of the axial end openings exactly once during each rotation of the block; and at least one fluid exhaust passageway communicating with each of the axial end openings exactly once during each rotation of the block;

whereby the axial piston rotary power device is adapted to function as one of a two-cycle fluid-driven compressor and a two-cycle fluid-driven pump.

20. The axial piston rotary power device of claim 19 wherein each of the fluid intake and fluid exhaust passageways comprises a semicircular groove formed in the inner face of the second end plate portion of the external stator.

21. The rotary power device of claim 1 wherein the internal stator portion further comprises at least one axial lubrication passageway for supplying lubricant fluid to a clearance space between the central stator portion and the block.

22. The rotary power device of claim 1 wherein the external stator portion comprises at least one passageway for supplying lubricant fluid to and for withdrawing lubricant fluid from the annular rotor recess.

23. A four-cycle internal combustion engine having an output shaft fixedly attached to a cylindrical block rotatable about an axis of the shaft and received within an external portion of a stator, the external portion of the stator having an axially undulating guide surface fixed thereto, the axially undulating guide surface comprising a first pair of points at which the surface is a maximum axial distance from a first selected axial position and a second pair of points at which the surface is a minimum axial distance from the first selected axial position;

the cylindrical block comprising:

a central cylindrical bore extending through the block along an axis of the shaft;

a medial annular recess extending through an outer cylindrical wall of the cylindrical block;

a selected number of cylindrical cavities parallel to the shaft and disposed at a single radial distance from the axis, each cylindrical cavity comprising a pair of working cylinders axially spaced apart on opposite sides of the medial annular recess; each working cylinder having an inner end proximal the medial annual recess and open thereto, each working cylinder having a closeable outer end distal from the medial annular recess, each of the working cylinders having a respective radially inwardly directed opening adjacent the closeable end thereof, the radially inwardly directed opening of one working cylinder in each pair thereof communicating with the central cylindrical bore at the first selected axial position, the radially inwardly directed opening associated with the second working cylinder in the each pair thereof communicating with the central cylindrical bore at a second selected axial position;

the selected number of piston assemblies, each piston assembly slidably received in a respective cylindrical cavity; each piston assembly comprising two axially spaced apart piston heads having a respective middle portion extending therebetween, each middle portion comprising at least a respective pair of rotatable roller cam followers for following the axially undulating guide surface received in the medial annual recess, each middle portion further comprising a respective cam follower pin for slidably engaging a respective axial groove formed in a wall of the respective cylindrical cavity;

the engine further comprising an internal portion of the stator received in the cylindrical bore of the cylindrical block, the internal portion of the stator having a plurality of passageways formed therein, each of the passageways comprising a channel parallel to the axis of the shaft, each of the channels communicating with at least one respective radial port formed in the internal stator at one of the selected axial positions, at least one of the plurality of passageways comprising an inlet passageway, a second at least one of the plurality of passageways comprising an exhaust passageway, and two of the passageways comprising ignition passageways comprising respective ignition ports, each of the ignition ports comprising means for receiving an igniter therein.

24. The four-cycle internal combustion engine of claim 23 wherein the axially undulating guide surface comprises a protrusion from an inner surface of the external portion of the stator.

25. The four-cycle internal combustion engine of claim 23 wherein the axially undulating guide surface comprises two separate portions attached to each other along a line that is a diagonal of the cylindrical block.

26. The four-cycle internal combustion engine of claim 23 wherein the means for receiving an igniter comprises a threaded portion of each ignition port.

27. A two-cycle internal combustion engine having an output shaft fixedly attached to a cylindrical block rotatable about an axis of the shaft and received within an external portion of a stator having an axially undulating guide surface fixed thereto, the axially undulating guide surface comprising exactly one point at which the surface is a maximum axial distance from a first selected axial position and exactly one point at which the surface is a minimum axial distance from the first selected axial position;

the cylindrical block comprising:

an outer wall comprising a medial annular recess for receiving the axially undulating guide surface;

a central cylindrical bore for receiving an internal portion of the stator, the central cylindrical bore extending through the block along the axis;

a selected number of cylindrical cavities parallel to the shaft and disposed at a single radial distance from the axis, each cylindrical cavity further comprising a pair of working cylinders axially spaced apart on opposite sides of the medial annular recess; each working cylinder having an inner end proximal the medial annual recess and open thereto, each working cylinder having a closeable outer end distal from the medial annular recess, each of the working cylinders having a respective radially inwardly directed outer end opening adjacent the closeable end thereof, the outer end opening of a first working cylinder in each pair thereof communicating with the central cylindrical bore at the first selected axial position, the outer end opening associated with the second working cylinder in the each pair thereof communicating with the central cylindrical bore at a second selected axial position; each of the working cylinders further having a respective radially inwardly directed medial end opening adjacent the inner end thereof, the respective medial end opening of the first working cylinder in each pair thereof communicating with the central cylindrical bore at a third selected axial position closer to the first axial position than to the second, the respective medial end opening of the second working cylinder in each pair thereof communicating with the central cylindrical bore at a fourth selected axial position closer to the second axial position than to the first; each of the cylindrical cavities further comprising a respective axial groove extending between its associated pair of working cylinders;

the selected number of piston assemblies, each piston assembly slidably received in a respective cylindrical cavity; each piston assembly comprising two axially spaced apart piston heads having a respective middle portion extending therebetween, each middle portion comprising at least a respective pair of rotatable roller cam followers for following the axially undulating guide surface received in the medial annual recess, each middle portion further comprising a respective cam follower pin for slidably engaging a respective axial groove formed in a wall of the respective cylindrical cavity;

wherein the engine further comprises:

a plurality of passageways formed in the internal stator, each of the passageways comprising a channel parallel to the axis of the shaft, each of the channels communicating with at least one respective radial port formed in the internal stator at one of the selected axial positions, at least one of the plurality of passageways comprising an inlet passageway, a second at least one of the plurality of passageways comprising an exhaust passageway, and at least one of the plurality of passageways comprising a fuel injection passageway.

28. The two-cycle internal combustion engine of claim 27 wherein the axially undulating protruding guide surface comprises a protrusion extending from an inner surface of a middle portion of the external portion of the stator.

29. The two-cycle internal combustion engine of claim 27 wherein the axially undulating guide surface is comprised of two separate portions joined along a line that is a diagonal of the cylindrical block.

30. An axial piston rotary power device operable as one of a compressor and a pump, the device having an input shaft fixedly attached to a cylindrical block rotatable about an axis of the shaft within an external portion of a stator, the external portion of the stator comprising a middle portion having a generally cylindrical interior and two end plate portions spaced apart by the middle portion;

wherein the cylindrical block comprises:

an outer wall comprising a medial annular recess for receiving an axially undulating guide surface portion of the external portion of the stator and a central cylindrical bore for receiving an internal stator portion of the stator, the central cylindrical bore extending through the block along an axis of the shaft;

a selected number of cylindrical cavities parallel to the shaft and disposed at a single radial distance from the axis thereof, each cavity comprising a pair of working cylinders axially spaced apart on opposite sides of the medial annular recess, each working cylinder having an inner end proximal the medial annual recess and open thereto, each working cylinder having a closeable outer end distal from the medial annular recess, each of the working cylinders having a respective radially inwardly directed opening adjacent the closeable end thereof, the respective radially inwardly directed opening of one working cylinder in each pair thereof communicating with the central cylindrical bore at a first selected axial position, the respective radially inwardly directed opening associated with the second working cylinder in the each pair thereof communicating with the central cylindrical bore at a second selected axial position;

the selected number of piston assemblies, each piston assembly slidably received in a respective cylindrical cavity; each piston assembly comprising two axially spaced apart piston heads having a respective piston middle portion extending therebetween, each piston middle portion comprising at least a respective pair of rotatable roller cam followers for following the axially undulating guide surface received in the medial annual recess, each piston middle portion further comprising a respective cam follower pin for slidably engaging a respective axial groove formed in a wall of the respective cylindrical cavity;

wherein the compressor further comprises:

a plurality of passageways formed in the internal stator portion, each of the passageways comprising a channel parallel to the axis of the shaft, each of the channels communicating with at least one respective radial port formed in the internal stator at one of the selected axial positions, at least one of the plurality of passageways comprising an inlet passageway, a second at least one of the plurality of passageways comprising an exhaust passageway; and wherein the axially undulating guide surface has a selected number, equal to or greater than one, of points at which the surface is a maximum axial distance from the first selected axial position and the selected number of points at which the surface is a minimum axial distance from the first selected axial position.

* * * * *

UNITED STATES PATENT AND TRADEMARK OFFICE

CERTIFICATE OF CORRECTION

PATENT NO. : 6,601,548 B2
DATED : August 5, 2003
INVENTOR(S) : Al-Hawaj

It is certified that error appears in the above-identified patent and that said Letters Patent is hereby corrected as shown below:

Column 15,
Line 23, the phrase "… adjacent a respective outer end of the second cylinder…" was erroneously rendered as -- … adjacent a respective counter end of the second cylinder… --.

Signed and Sealed this

Fifth Day of October, 2004

JON W. DUDAS
*Director of the United States Patent and Trademark Office*